US011823643B2

(12) United States Patent
Tsuboi et al.

(10) Patent No.: US 11,823,643 B2
(45) Date of Patent: Nov. 21, 2023

(54) LIGHT-EMITTING APPARATUS, DISPLAY APPARATUS, PHOTOELECTRIC CONVERSION APPARATUS ELECTRONIC DEVICE, ILLUMINATION APPARATUS, MOVING BODY, AND WEARABLE DEVICE

(71) Applicant: CANON KABUSHIKI KAISHA, Tokyo (JP)

(72) Inventors: Hiromasa Tsuboi, Tokyo (JP); Shinya Igarashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 36 days.

(21) Appl. No.: 17/568,810

(22) Filed: Jan. 5, 2022

(65) Prior Publication Data

US 2022/0223120 A1 Jul. 14, 2022

(30) Foreign Application Priority Data

Jan. 13, 2021 (JP) ..... 2021-003726

(51) Int. Cl.
*G09G 3/3258* (2016.01)
*G09G 5/10* (2006.01)

(52) U.S. Cl.
CPC ..... *G09G 5/10* (2013.01); *G09G 3/3258* (2013.01); *G09G 2380/10* (2013.01)

(58) Field of Classification Search
CPC ..... G09G 5/10; G09G 3/3258; G09G 3/3291; G09G 3/3696
See application file for complete search history.

(56) References Cited

U.S. PATENT DOCUMENTS

| | | | | |
|---|---|---|---|---|
| 8,766,883 | B2 * | 7/2014 | Wacyk | G09G 3/3233 345/76 |
| 10,818,232 | B2 | 10/2020 | Tsuboi et al. | |
| 10,867,561 | B2 | 12/2020 | Ota et al. | |
| 10,998,392 | B2 | 5/2021 | Tsuboi | |
| 11,087,680 | B2 | 8/2021 | Tsuboi et al. | |
| 2015/0287353 | A1 * | 10/2015 | Song | G09G 3/2022 345/77 |
| 2020/0126481 | A1 | 4/2020 | Tsuboi | |

(Continued)

FOREIGN PATENT DOCUMENTS

JP 2016-027439 A 2/2016

OTHER PUBLICATIONS

U.S. Appl. No. 17/573,735, filed Jan. 12, 2022.

*Primary Examiner* — Antonio A Caschera
(74) *Attorney, Agent, or Firm* — Venable LLP

(57) ABSTRACT

A light-emitting apparatus comprising pixels that each includes a light-emitting element and a drive transistor for supplying a current according to a luminance signal to the light-emitting element and a signal supply circuit supplying the luminance signal to the drive transistor. The apparatus operates display modes including a first display mode and a second display mode in which a maximum luminance is higher than in the first display mode. The signal supply circuit, in a case where the display data has a maximum luminance value, supplies to the drive transistor, as the luminance signal, different voltages in the first and second display modes, and in a case where the display data has a minimum luminance value, supplies to the drive transistor, as the luminance signal, different voltages in the first and second display modes.

19 Claims, 18 Drawing Sheets

(56) References Cited

U.S. PATENT DOCUMENTS

| | | | |
|---|---|---|---|
| 2021/0005142 | A1 | 1/2021 | Tsuboi et al. |
| 2021/0111227 | A1 | 4/2021 | Tsuboi |
| 2021/0375233 | A1 | 12/2021 | Nagasaki et al. |
| 2021/0384280 | A1 | 12/2021 | Akiyama et al. |

* cited by examiner

LIGHT-EMITTING APPARATUS, DISPLAY APPARATUS, PHOTOELECTRIC CONVERSION APPARATUS ELECTRONIC DEVICE, ILLUMINATION APPARATUS, MOVING BODY, AND WEARABLE DEVICE

BACKGROUND OF THE INVENTION

Field of the Invention

The present invention is related to a light-emitting apparatus, a display apparatus, a photoelectric conversion apparatus, an electronic device, an illumination apparatus, a moving body, and a wearable device.

Description of the Related Art

Japanese Patent Laid-Open No. 2016-027439 describes a display apparatus that switches among a plurality of display states having different maximum luminances set for a display element when display data is a maximum luminance value.

When changing a drive voltage at each luminance value in accordance with the switching of a light-emission drive voltage at a maximum luminance value as in Japanese Patent Laid-Open No. 2016-027439, the shape of a gamma curve exhibiting a relationship between luminance value and actual emission luminance of the display data may change depending on the respective display state. If the gamma curve changes, the display quality may deteriorate.

SUMMARY OF THE INVENTION

It is an object of some embodiments of the present invention to provide a technique that is advantageous in switching a plurality of display modes in a light-emitting apparatus.

According to some embodiment, a light-emitting apparatus comprising a plurality of pixels that each includes a light-emitting element and a drive transistor for supplying a current according to a luminance signal to the light-emitting element and a signal supply circuit configured to supply the luminance signal to the drive transistor in accordance with display data, wherein the light-emitting apparatus is configured to operate in a plurality of display modes including a first display mode and a second display mode in which a maximum luminance is higher than in the first display mode, and the signal supply circuit, in a case where the display data has a maximum luminance value, supplies to the drive transistor, as the luminance signal, different voltages in the first display mode and the second display mode, and in a case where the display data has a minimum luminance value, supplies to the drive transistor, as the luminance signal, different voltages in the first display mode and the second display mode, is provided.

Further features of the present invention will become apparent from the following description of exemplary embodiments (with reference to the attached drawings).

DESCRIPTION OF THE EMBODIMENTS

Figure 1:
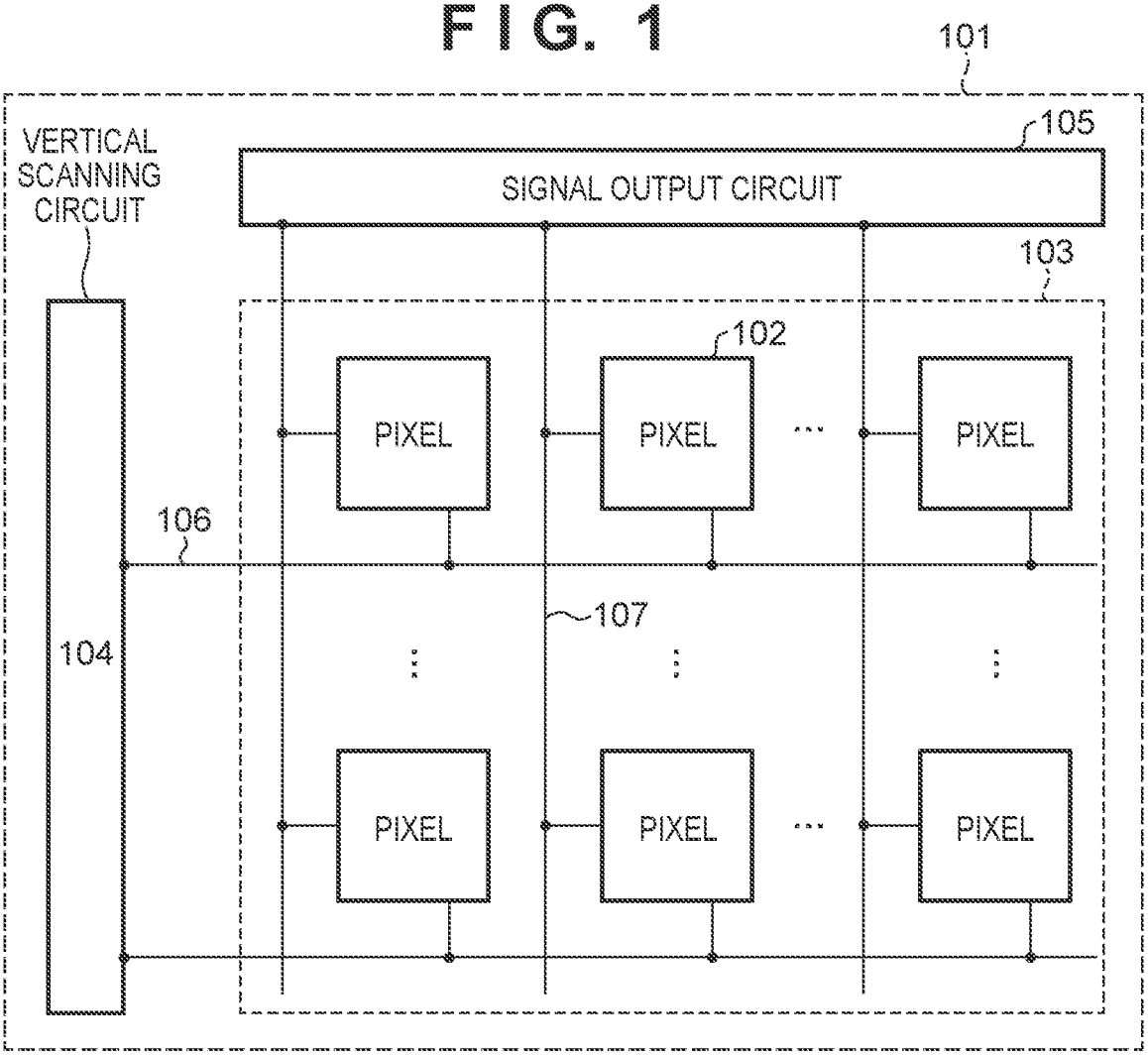
FIG. 1 is a diagram illustrating an outline of a light-emitting apparatus of the present embodiment.

Hereinafter, embodiments will be described in detail with reference to the attached drawings. Note, the following embodiments are not intended to limit the scope of the claimed invention. Multiple features are described in the embodiments, but limitation is not made to an invention that requires all such features, and multiple such features may be combined as appropriate. Furthermore, in the attached drawings, the same reference numerals are given to the same or similar configurations, and redundant description thereof is omitted.

A light-emitting apparatus according to an embodiment of the present disclosure will be described with reference to FIGS. 1 to 12. FIG. 1 is a system view illustrating an outline of a light-emitting apparatus 101 of the present embodiment. The light-emitting apparatus 101 illustrated in FIG. 1 is a light-emitting apparatus in which light-emitting elements arranged in the respective pixels 102 are driven by driving circuits corresponding to the respective light-emitting elements formed on the substrate of the semiconductor. The light-emitting elements may be of any material composition or structure, such as liquid crystal, organic light-emitting diode (OLED, organic EL), inorganic LED, and quantum dot. In the present embodiment, the light-emitting apparatus 101 will be described as including a light-emitting element using an organic EL. Further, as described later, in the present embodiment, a case where the drive transistor is connected to the anode of the organic EL element, and the transistors are all P-type transistors will be described, but the invention is not limited thereto. For example, the polarities and conductivity types of transistors or semiconductor layers, such as a substrate on which a transistor is formed, may all be reversed. Further, for example, a drive transistor for supplying a current according to the luminance signal to the light-emitting element may be a P-type transistor, and other transistors may be N-type transistors. Thus, in the following, for example, the "drain region" and "source region" of the transistor may be switched as appropriate. Depending on the conductivity type and polarity of the respective configurations of the light-emitting apparatus 101, the potential supplied and the connection between the respective configurations may be changed as appropriate.

Figure 2:
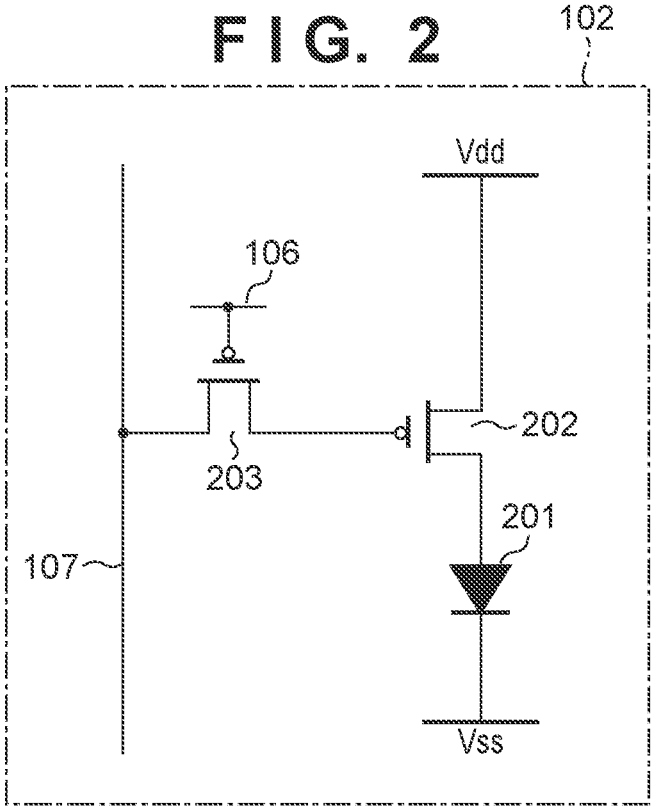
FIG. 2 is a circuit diagram of a pixel of the light-emitting apparatus of FIG. 1.

The light-emitting apparatus 101 illustrated in FIG. 1 includes a pixel array 103, and a driving unit disposed around the pixel array 103. The pixel array 103 includes a plurality of pixels 102 arranged in a two-dimensional array in a matrix, and each pixel 102 has a light-emitting element 201 as illustrated in FIG. 2. The light-emitting element 201 includes an organic layer including a light-emitting layer between anode and cathode electrodes. In addition to the light-emitting layer, the organic layer may include one or more of a hole injection layer, a hole transport layer, an electron injection layer, and an electron transport layer as appropriate. As described above, the light-emitting apparatus 101, which comprises the light-emitting element 201 including an organic compound in a light-emitting layer, can also be referred to as an organic EL display apparatus.

A drive unit may be a circuit for driving respective pixels 102. The drive unit includes, for example, a vertical scanning circuit 104 and a signal supply circuit 105. In the pixel array 103, along the row direction (lateral direction in FIG. 1), a scan line 106 is arranged for each pixel row. Further, along the column direction (vertical direction in FIG. 1), a signal line 107 is arranged for each pixel column.

A scan line 106 is connected to the output end of each corresponding row of vertical scanning circuit 104. A signal line 107 is connected to the output end of each corresponding row of the signal supply circuit 105. The vertical scanning circuit 104 supplies a write control signal to the scan line 106 when writing a luminance signal (also referred to as a video signal) corresponding to the display data D to the respective pixels 102 of the pixel array 103. The signal supply circuit 105 outputs a luminance signal having a voltage Vsig corresponding to the display data D of the digital signal supplied from the outside of the light-emitting apparatus 101.

FIG. 2 is a circuit diagram illustrating a configuration example of a pixel 102 arranged in the light-emitting apparatus 101 of FIG. 1. As illustrated in FIG. 2, the pixel 102 includes a light-emitting element 201, a drive transistor 202, and a write transistor 203.

The total number of respective elements, such as transistors, included in the pixel 102 illustrated in FIG. 2, and the combination of the conductivity type of the transistors are only one example and the invention is not limited to the present configuration. For example, a capacitor (e.g., a parasitic capacitance) (not shown) may be connected to the transistor illustrated in FIG. 2. Further, the expression "a transistor is connected between the element A and the element B in the following description" is intended to mean one of the main terminals of the transistor is connected to the element A, and another of the main terminals of the transistor is connected to the element B. That is, the expression "the transistor is connected between the element A and the element B" is not intended to include the case where a control terminal of the transistor is connected to the element A, one of the main terminals is not connected, and another of the main terminals is not connected to the element B. Here, the main terminal of the transistor refers to a diffusion region which functions as a source region or drain region of the transistor. Further, the control terminal of the transistor refers to the gate electrode of the transistor.

In the configuration shown in FIG. 2, one of the main terminals of the drive transistor 202 (drain region in the configuration of FIG. 2) is connected to the main terminal (referred to as electrode. described below as the anode) of one of the light-emitting elements 201. Another of the main terminals of the drive transistor 202 (source region in the configuration of FIG. 2) is connected to the power supply terminal Vdd. Another main terminal not connected to the drive transistor 202 of the light-emitting element 201 (hereinafter, described as the cathode) is connected to the power supply terminal Vss.

One of the main terminals of the write transistor 203 is connected to the control terminal of the drive transistor 202, and another of the main terminals of the write transistor 203 is connected to the signal line 107. The control terminal of write transistor 203 is connected to scan line 106.

The drive transistor 202 supplies a current from the power supply terminal Vdd to the light-emitting element 201 to cause the light-emitting element 201 to emit light. More specifically, the signal supply circuit 105 supplies a luminance signal to the drive transistor 202 in response to the display data D, and the drive transistor 202 supplies a current corresponding to the voltage Vsig supplied as a luminance signal via the signal line 107 to the light-emitting element 201. As a result, the light-emitting element 201 can emit light by a current being driven.

The write transistor 203 is responsive to a write control signal applied from the vertical scanning circuit 104 to the control terminal via the scan line 106 and is in a conducting state (which may also be referred to as an on state). Thus, the write transistor 203 writes the voltage Vsig of the luminance signal corresponding to the display data D supplied from the signal supply circuit 105 to the pixel 102 via the signal line 107. The voltage Vsig of the written luminance signal is applied to the control terminal of the drive transistor 202. The voltage applied to the back gate terminal of any transistor (may also be referred to as a substrate terminal, a bulk terminal, a body terminal, etc.) is equal to the voltage of the power supply terminal Vdd. In other words, the back gate terminal of the drive transistor 202 and the write transistor 203 may be connected to the power supply terminal Vdd.

During light emission of the organic EL (Organic Electroluminescent) element, which is a light-emitting element 201, the amount of current flowing between the main terminals of the drive transistor 202 changes in accordance with the voltage Vsig of the luminance signal. Thus, the capacitance between the anode and the cathode of the light-emitting element 201 is charged to a predetermined potential, and a current corresponding to the potential difference between the anode and the cathode flows through the organic layer which includes a light emitting layer of the light-emitting element 201. Thus, the light-emitting element 201 is enabled to emit light at a luminance corresponding to the display data D.

Figure 3A:
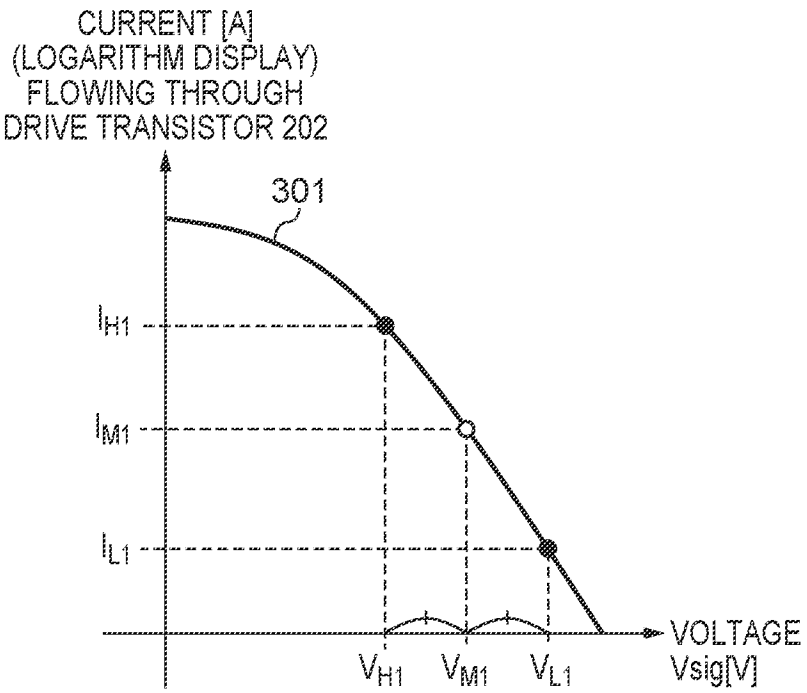
FIGS. 3A and 3B are electrical characteristics and emission characteristics of pixels of the light-emitting apparatus of FIG. 1.

In FIG. 3A, an electrical characteristic of the pixel 102 are illustrated. More specifically, in a certain display mode (hereinafter, described as display mode A), a range of the voltage Vsig of the luminance signal written to the control terminal of the drive transistor 202, and a current characteristic 301 of the drive transistor 202 with respect to the voltage Vsig are illustrated. In FIG. 3A, the vertical axis is a logarithmic representation. The voltage Vsig of the luminance signal to be written to the drive transistor 202 of the pixel 102 is $V_{M1}$, and $V_{L1}$ respectively when the display data D has a maximum luminance value, an intermediate luminance value, and a minimum luminance value. The magnitude relation of these voltage values of the voltage Vsig, as illustrated in FIG. 3A, is $V_{H1}<V_{M1}<V_{L1}$. Further, the voltage Vsig of the luminance signal when the display data D is an intermediate luminance value is $V_{M1}=(V_{H1}+V_{L1})/2$. Further, when each of $V_{H1}$, $V_{M1}$, and $V_{L1}$ is supplied as the voltage Vsig of the luminance signal, the current flowing through the drive transistor 202 is $I_{H1}$, $I_{M1}$, and $I_{L1}$, respectively.

Figure 3B:
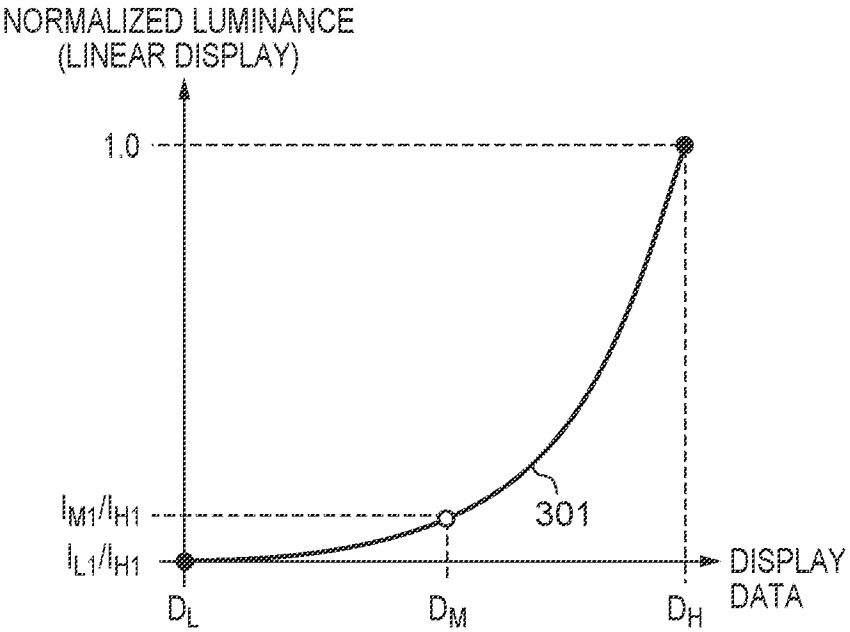

In FIG. 3B, a gamma curve 302 representing emission characteristics of the light-emitting element 201 of the pixel 102 in the display mode A is expressed. The voltage Vsig of the luminance signal corresponding to $D_H$ whose display data D has a maximum luminance value is $V_{H1}$ described above. Similarly, the voltage Vsig of the luminance signal corresponding to $D_L$ at which the display data D has a minimum luminance value is $V_{L1}$. Further, the voltage Vsig of the luminance signal corresponding to $D_M$ having an intermediate luminance value between $D_H$ at which the display data D has the maximum luminance value and $D_L$ where the display data D has the minimum luminance value is $V_{M1}$. The current flowing through the drive transistor 202 and the luminance at which the light-emitting element 201 emits light are in an approximately proportional relationship. Therefore, with respect to the display data $D_H$, $D_M$, and $D_L$, normalized luminances which are normalized by a luminance at a time when the display data $D_H$ has the maximum luminance value is supplied are respectively 1.0, $I_{M1}/I_{H1}$, and $I_{L1}/I_{H1}$.

Comparing against the case shown in FIG. 3A, operation of the light-emitting apparatus 101 in a display mode (hereinafter, described as display mode B) in which the maximum luminance set when the display data D has the maximum luminance value is higher than that of the display mode A will be described. After operation of the light-emitting apparatus 101 of the comparative example is first described with reference to FIG. 4A and FIG. 4B, the operation of the light-emitting apparatus 101 of the present embodiment will be described with reference to FIG. 5A and FIG. 5B, and an effect of operation of the light-emitting apparatus 101 of the present embodiment will be described.

Figure 4A:
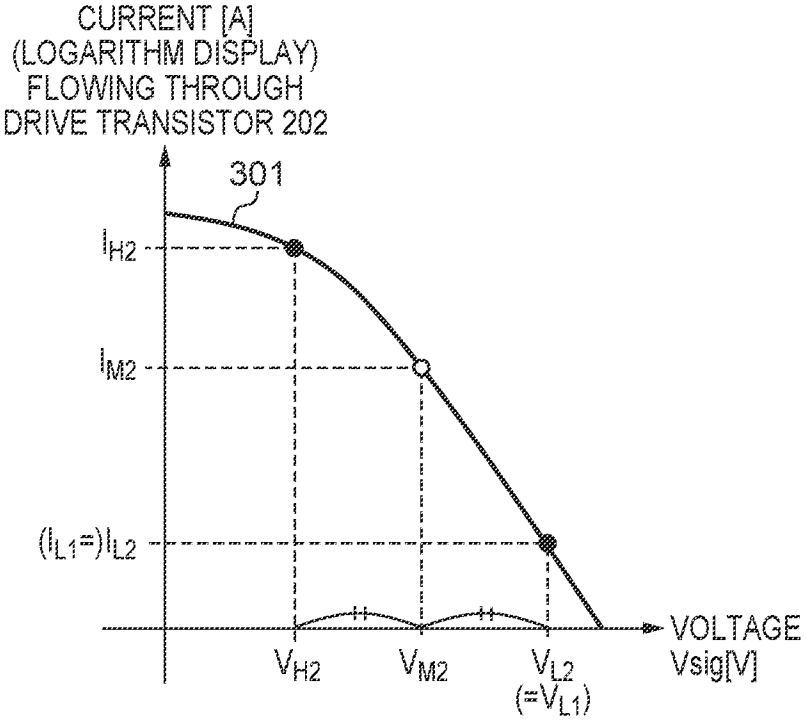
FIGS. 4A and 4B are electrical characteristics and emission characteristics of pixels of the light-emitting apparatus of the comparative example.

In FIG. 4A, in the display mode B, a range of the voltage Vsig of the luminance signal to be written to the control terminal of the drive transistor 202 is illustrated. In the operation of the light-emitting apparatus 101 of the comparative example, when the display data D in the display mode B has a maximum luminance value, an intermediate luminance value, and a minimum luminance value, the voltage Vsig of the luminance signal to be written to the drive transistor 202 of the pixel 102 is $V_{H2}$, $V_{M2}$, and $V_{L2}$, respectively. The magnitude relation of these voltage values of the voltage Vsig is $V_{H2}<V_{M2}<V_{L2}$. Further, the voltage Vsig of the luminance signal when the display data D is an intermediate luminance value is $V_{M2}=(V_{H2}+V_{L2})/2$.

The difference between the display mode A and the display mode B in the operation of the light-emitting apparatus 101 of the comparative example is that $V_{H2}<V_{H1}$ and $V_{M2}<V_{M1}$ for the voltage Vsig of the luminance signal when the display data D has a maximum luminance value and an intermediate luminance value respectively. Further, in the operation of the light-emitting apparatus 101 of the comparative example, the voltage Vsig of the luminance signal when the display data D is the minimum luminance value is equal in the display mode A and the display mode B where $V_{L1}=V_{L2}$. Further, when each of $V_{H2}$, $V_{M2}$, and $V_{L2}$ is supplied as the voltage Vsig of the luminance signal, the current flowing through the drive transistor 202 is $I_{H2}$, $I_{M2}$, and $I_{L2}$ respectively. Further, as compared with the current flowing through the drive transistor 202 for the display mode A, the relationships $I_{H2}>I_{H1}$, $I_{M2}>I_{M1}$, $I_{L2}=I_{L1}$ hold. Here, because the drive transistor 202 operates in a subthreshold region or saturation region, the slope of the current characteristic 301 also decreases as the voltage value of the signal voltage Vsig becomes low (small). Therefore, the ratio of the current amount corresponding to the maximum luminance value and the intermediate luminance value of the display data D is different between the display mode A and the display mode B. Specifically, it is expressed by the following Equation (1).

$$I_{M2}/I_{H2}>I_{M1}/I_{H1} \tag{1}$$

Figure 4B:
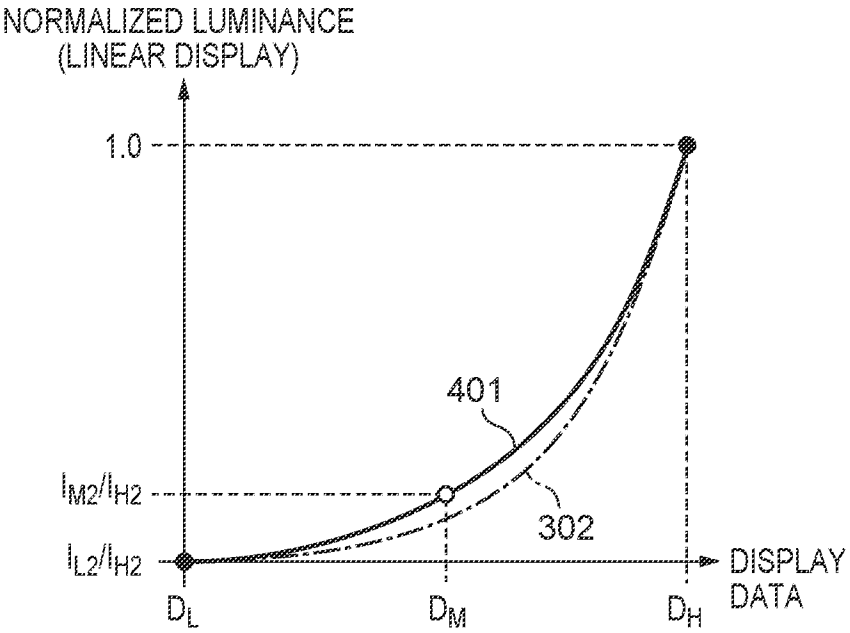

In the FIG. 4B, a gamma curve 401 representing emission characteristics of the light-emitting element 201 of the pixel 102 in the display mode B in operation of the light-emitting apparatus 101 of the comparative example is expressed. The voltage Vsig of the luminance signal corresponding to the cases where the display data D is $D_H$, $D_M$, and $D_L$, respectively, is the above-described $V_{H2}$, $V_{M2}$, and $V_{L2}$ respectively. In the operation of the light-emitting apparatus 101 of the comparative example, normalized luminances which are normalized by a luminance at a time when the display data $D_H$ having the maximum luminance value is supplied are respectively 1.0, $I_{M2}/I_{H2}$, and $I_{L2}/I_{H2}$. In the operation of the light-emitting apparatus 101 of the comparative example, it can be seen from the relationship of Equation (1) that the shape of the gamma curve 401 of the display mode B and the shape of the gamma curve 302 of the display mode A is different. When the shape of the gamma curve illustrating the relationship between the luminance value and the actual emission luminance of the display data D is different between the respective display modes, the balance of the luminance between each color of the light-emitting element 201 will be different depending on the display mode, and there is a possibility that the color of the displayed image will differ. In other words, there is a possibility that the display quality of the light-emitting apparatus 101 will suffer.

Figure 5A:
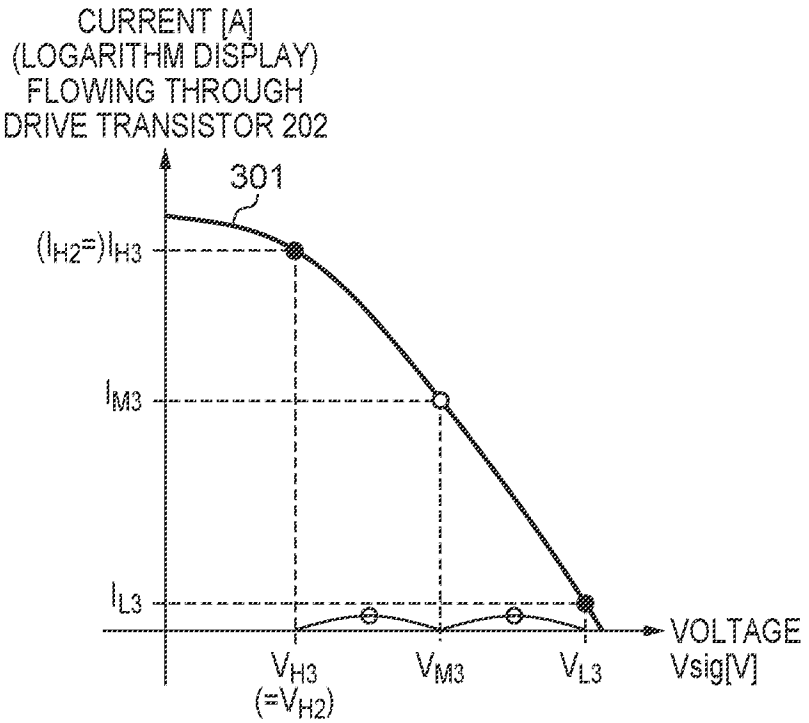
FIGS. 5A and 5B are electrical characteristics and emission characteristics of pixels of the light-emitting apparatus of FIG. 1.
Figure 5B:
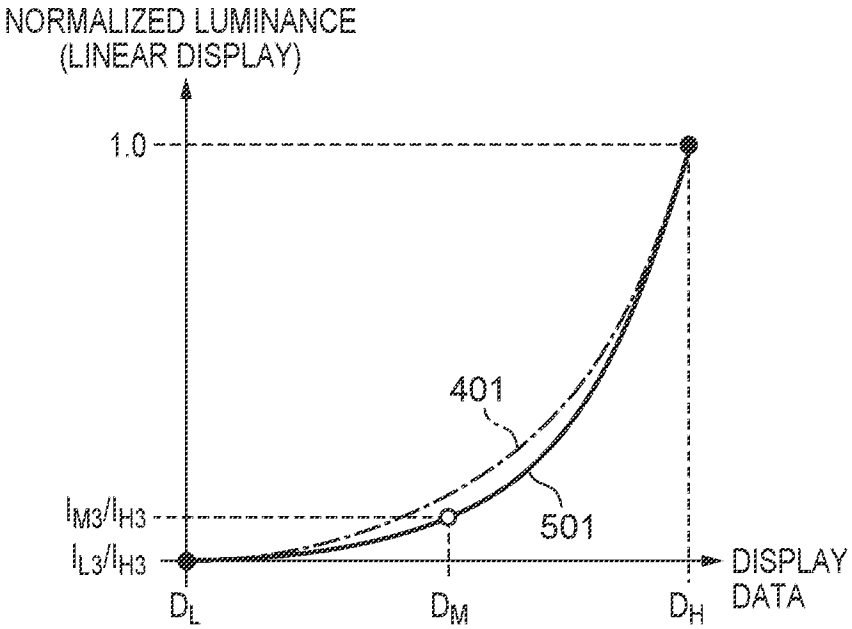

Next, the operation of the light-emitting apparatus 101 of the present embodiment will be described. In FIG. 5A, in the display mode B, a range of the voltage Vsig of the luminance signal to be written to the control terminal of the drive transistor 202 is illustrated. In the present embodiment, when the display data D in the display mode B of the light-emitting apparatus 101 has a maximum luminance value, an intermediate luminance value, and a minimum luminance value, the voltage Vsig of the luminance signal to be written to the drive transistor 202 of the pixel 102 is $V_{H3}$, $V_{M3}$, and $V_{L3}$, respectively. The magnitude relation of these voltage values of the voltage Vsig is $V_{H3}<V_{M3}<V_{L3}$. Further, the voltage Vsig of the luminance signal when the display data D is an intermediate luminance value is $V_{M3}=(V_{H3}+V_{L3})/2$.

$V_{L3}>V_{L2}=V_{L1}$ and $V_{M3}>V_{M2}$ for the voltage Vsig of the luminance signal of the light-emitting apparatus 101 of the present embodiment illustrated in FIG. 5A, when compared with the voltage Vsig of the luminance signal of the comparative example of FIG. 4A. The voltage Vsig of the luminance signal when the display data D is the maximum luminance value is equal to the present embodiment and the comparative example where $V_{H3}=V_{H2}$. When each of $V_{H3}$, $V_{M3}$, and $V_{L3}$ is supplied as the voltage Vsig of the luminance signal, the current flowing through the drive transistor 202 is $I_{H3}$, $I_{M3}$, and $I_{L3}$ respectively. Here, $I_{L3}<I_{L2}=I_{L1}$, $I_{M3}<I_{M2}$, and $I_{H3}=I_{H2}$.

In the operation of the present embodiment, the light-emitting apparatus 101 operates in the display mode A and the display mode B which has a higher maximum luminance than the display mode A. The signal supply circuit 105 supplies a different voltage Vsig as a luminance signal in the display mode A and the display mode B to the drive transistor 202 ($V_{H1}\neq V_{H3}$) when the display data D has the maximum luminance value. The signal supply circuit 105 supplies a different voltage Vsig as a luminance signal in the display mode A and the display mode B to the drive transistor 202 ($V_{L1}\neq V_{L3}$) when the display data D has the minimum luminance value. A gamma curve 501 representing emission characteristics of the light-emitting element 201 of the pixel 102 in the display mode B of the present embodiment is expressed in FIG. 5B.

The voltage Vsig of the luminance signal corresponding to the cases where the display data D is $D_H$, $D_M$, and $D_L$, respectively, is the above-described $V_{H3}$, $V_{M3}$, and $V_{L3}$ respectively. In the operation of the light-emitting apparatus 101 of the present embodiment, normalized luminances which are normalized by a luminance at a time when the display data $D_H$ having the maximum luminance value is supplied are respectively 1.0, $I_{M3}/I_{H3}$, and $I_{L3}/I_{H3}$. The normalized luminance in the operation of the present embodiment and the comparative example for the display mode B has the relationship $I_{M3}/I_{H3}<I_{M2}/I_{H2}$. Therefore, as illustrated in the FIG. 5B, the gamma curve 501 of the light-emitting apparatus 101 of the present embodiment is similar to the shape of the gamma curve 302 of the display mode A even in the display mode B as compared with the gamma curve 401 of the comparative example.

In the operation of the comparative example, for the signal supply circuit 105, when the display data D has the minimum luminance value, the voltage of the voltage Vsig of the luminance signal is the same ($V_{L1}=V_{L2}$) in the display mode A and the display mode B which has a higher maximum luminance than the display mode A. On the other hand, in the operation of the present embodiment, in both the case where the display data D is the maximum luminance value and the case where the display data D is the minimum luminance value, the voltage of the voltage Vsig of the luminance signal is a different voltage. Thus, the change in the voltage Vsig of the luminance signal when the display data D is an intermediate luminance value between the maximum and minimum is similar between the display mode A and the display mode B. More specifically, the signal supply circuit 105 supplies to the drive transistor 202 a voltage $V_{H1}$ as the voltage Vsig of the luminance signal in the display mode A and supplies to the drive transistor a voltage $V_{H3}$ whose voltage value is smaller than the voltage $V_{H1}$ as the voltage Vsig of the luminance signal in the display mode B when the display data D has the maximum luminance value. Also, the signal supply circuit 105 supplies to the drive transistor 202 a voltage $V_{L1}$ as the voltage Vsig of the luminance signal in the display mode A and supplies to the drive transistor 202 a voltage $V_{L3}$ whose voltage value is larger than the voltage $V_{L1}$ as the voltage Vsig of the luminance signal in the display mode B when the display data D has the minimum luminance value. In other words, the range of the voltage Vsig of the luminance signal is extended not only on the side where the display data D has a high luminance value, but also on the side where the display data D has a low luminance value. This makes it possible to suppress a change in the gamma curve when the display mode is switched in the light-emitting apparatus 101. As a result, it is possible to realize display of high-quality images and the like in the light-emitting apparatus 101.

Here, as illustrated in FIGS. 3A and 5A, the voltage difference between the voltage $V_{H1}$ in the display mode A and the voltage $V_{H3}$ in the display mode B of the luminance signal when the display data D is the maximum luminance value may be larger than the voltage difference between the voltage $V_{L1}$ in the display mode A and the voltage $V_{L3}$ in the display mode B of the luminance signal when the display data D is the minimum luminance value. That is, it may be $(V_{H1}-V_{H3})>(V_{L3}-V_{L1})$.

The display mode A and the display mode B may have the same number of gradations. Further, in each of the display mode A and the display mode B, the steps between each gradation of the voltage signal supply circuit 105 to be supplied as a luminance signal may be equally spaced. As a result, even when the display mode is changed, the light-emitting apparatus 101 can obtain the above-described effect with a relatively simple configuration without requiring a processor or the like for performing complicated calculation for suppressing a change in the gamma curve for each display mode. The display modes in which the light-emitting apparatus 101 displays are not limited to the two types described above. The operation may be performed by switching three or more display modes. Even in this case, as described above, the voltage Vsig of both the luminance signal when the luminance value of the display data D has the maximum value and the luminance signal when the luminance value of the display data D has the minimum value is changed as appropriate, and the voltage Vsig of the luminance signal corresponding to an intermediate luminance value may be changed accordingly.

Next, referring to FIG. 6 to FIG. 9B, a variation of the light-emitting apparatus 101 of the present embodiment will be described. The configuration illustrated in FIG. 6 to FIG. 9B is a configuration in which each of the pixels 102 is arranged in a current path including the light-emitting element 201 and the drive transistor 202, and further includes a light-emission control transistor 701 for controlling light emission or non-light emission of the light-emitting element 201. Hereinafter, configurations that differ from a configuration that has been described with reference to FIG. 1 to FIG. 5B described above will be mainly described, and description of configurations that may be the same will be abbreviated as appropriate.

Figure 6:
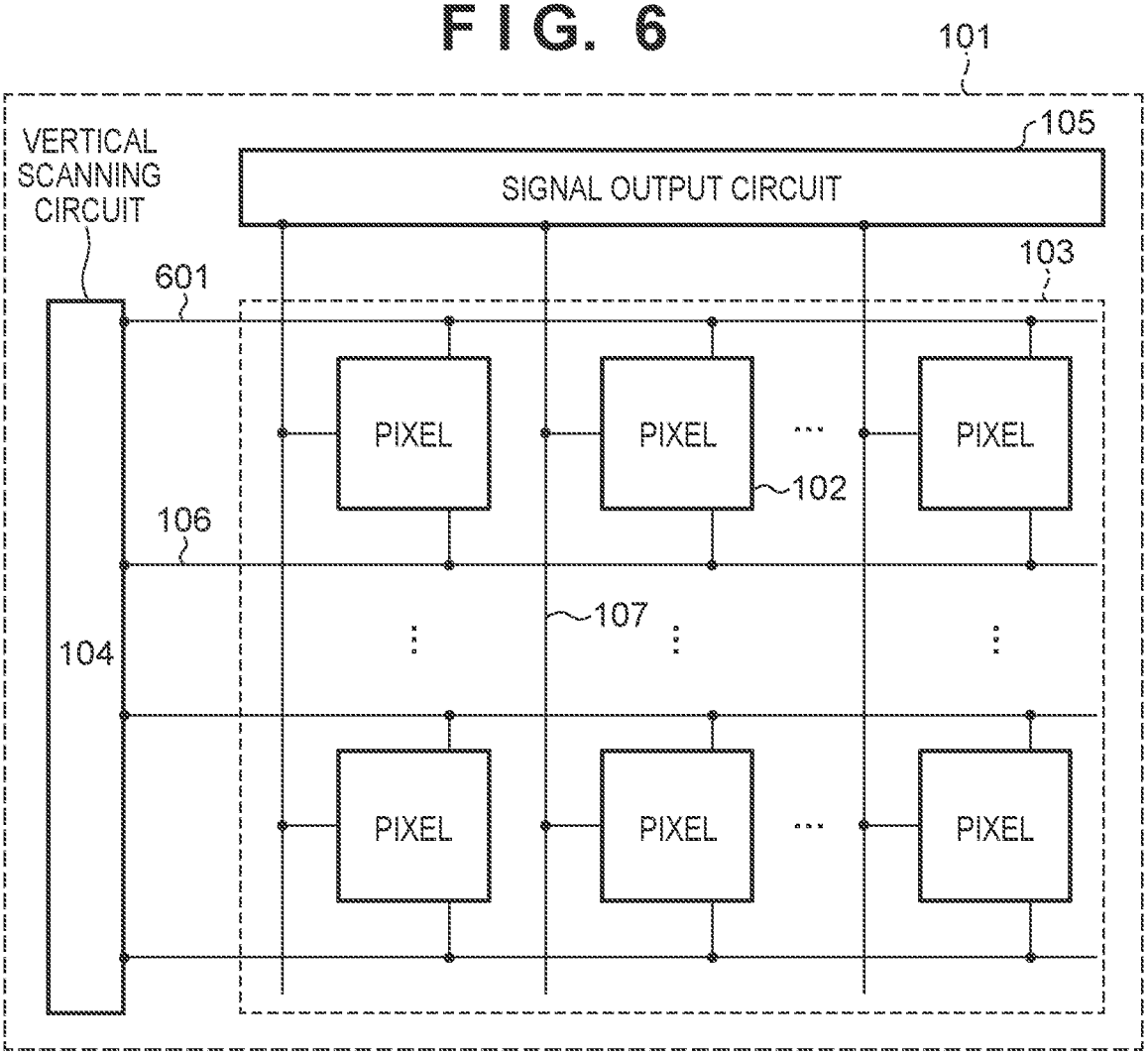
FIG. 6 is a diagram illustrating an outline of a light-emitting apparatus of the present embodiment.

FIG. 6 is a system view illustrating an outline of a light-emitting apparatus 101 of the present embodiment. In addition to the configuration illustrated in FIG. 1, in the pixel array 103, along the row direction, a scan line 601 is arranged for each pixel row. The scan lines 601 are connected to the output ends of respective corresponding rows of the vertical scanning circuit 104 and supply emission control signals to the light-emission control transistor 701 of the respective pixels 102.

Figure 7:
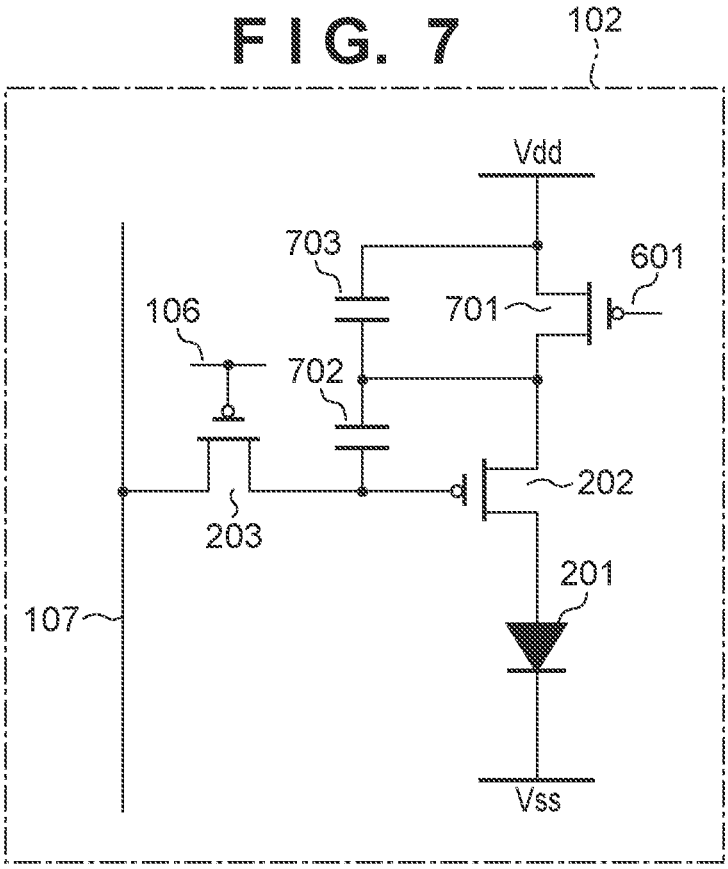
FIG. 7 is a circuit diagram of a pixel of the light-emitting apparatus of FIG. 6.

FIG. 7 is a circuit diagram illustrating a configuration example of a pixel 102 arranged in the light-emitting apparatus 101 of FIG. 6. As illustrated in FIG. 7, a light-emission control transistor 701 for controlling light emission or non-emission of the light-emitting element 201 being arranged is different from the configuration illustrated in FIG. 1. One of the main terminals of the light-emission control transistor 701 (source region in the configuration of FIG. 7) is connected to one of the main terminals of the drive transistor 202 (drain region in the configuration of FIG. 7). The other of the main terminals of the light-emission control transistor 701 is connected to the power supply terminal Vdd. The control terminal of the light-emission control transistor 701 is connected to the scan line 601. The back gate terminal of the light-emission control transistor may be the same voltage as the power supply terminal Vdd as described above, and may be connected to the power supply terminal Vdd, for example.

In the configuration illustrated in FIG. 7, the light-emission control transistor 701 is arranged between the power supply terminal Vdd and the drive transistor 202, but the configuration is not limited thereto. For example, the light-emission control transistor 701 may be arranged between the drive transistor 202 and the light-emitting element 201, or may be arranged between the light-emitting element 201 and the power supply terminal Vss. The light-emission control transistor 701 may be arranged on a current path that includes a light-emitting element 201 and a drive transistor 202.

In the configuration illustrated in FIG. 7, capacitive element 702 is arranged between the control terminal of the drive transistor 202 and a node between the drive transistor 202 and the light-emission control transistor 701 of the current path including the light-emitting element 201. Further, the capacitive element 703 is arranged between a node between the drive transistor 202 and the light-emission control transistor 701 and the power supply terminal Vdd. The capacitive element 702 and the capacitive element 703 may be constituted by a parasitic capacitance of the drive transistor 202 and the light-emission control transistor 701, respectively. Further, the capacitive element 702 and the capacitive element 703 may be elements having an MIM (Metal-Insulator-Metal) structure or the like arranged separately from the drive transistor 202 and the light-emission control transistor 701. Also, for example, the capacitive element 702 and the capacitive element 703 may be a combination of elements such as parasitic capacitance of the drive transistor 202 and the light-emission control transistor 701 and an MIM structure.

The light-emission control transistor 701 allows the supply of current from the power supply terminal Vdd to the drive transistor 202 by becoming conductive in response to a light-emission control signal applied from the vertical scanning circuit 104 to the control terminal via the scan line 601. This allows light emission of the light-emitting element 201 by the drive transistor 202. Thus, the light-emission control transistor 701 has a function as a switch for controlling the light emission or non-light emission of the light-emitting element 201. The switching operation of the light-emission control transistor 701 enables so-called duty control, by which it is possible to control the ratio between the light emitting period and the non-light emitting period of the light-emitting element 201. This duty control, over a frame period, can reduce afterimage blur associated with light emission by the pixel 102, and in particular, can improve image quality when displaying a moving image in the light-emitting apparatus 101.

Further, due to variations in manufacturing of the light-emitting apparatus 101, a threshold voltage of the drive transistor 202 may be different for each pixel 102. In this case, even when writing the voltage Vsig of the same luminance signal for a plurality of pixels 102 of the same light emitting color, the amount of current flowing through the drive transistor 202 will differ in the respective pixels 102, and the luminance of the light-emitting element 201 will vary. Therefore, the threshold voltage of the drive transistor 202, prior to writing the voltage Vsig of the luminance signal, is held between the gate-source of the drive transistor 202, performs a so-called threshold correction operation. This threshold correction operation, it is possible to suppress variations in the amount of current flowing through the drive transistor 202 in each pixel 102. As a result, more uniform light emission can be realized in the light-emitting apparatus 101.

In the threshold correction operation, after passing a current through the light-emission control transistor 701 and the drive transistor 202 to the light-emitting element 201, the light-emission control transistor 701 is put into a non-conducting state (which can also be referred to as an off state). Thereby, until the voltage between the gate and source of the drive transistor 202 is stabilized, a current flows to the light-emitting element 201, and the threshold value correction is performed.

Figure 8:
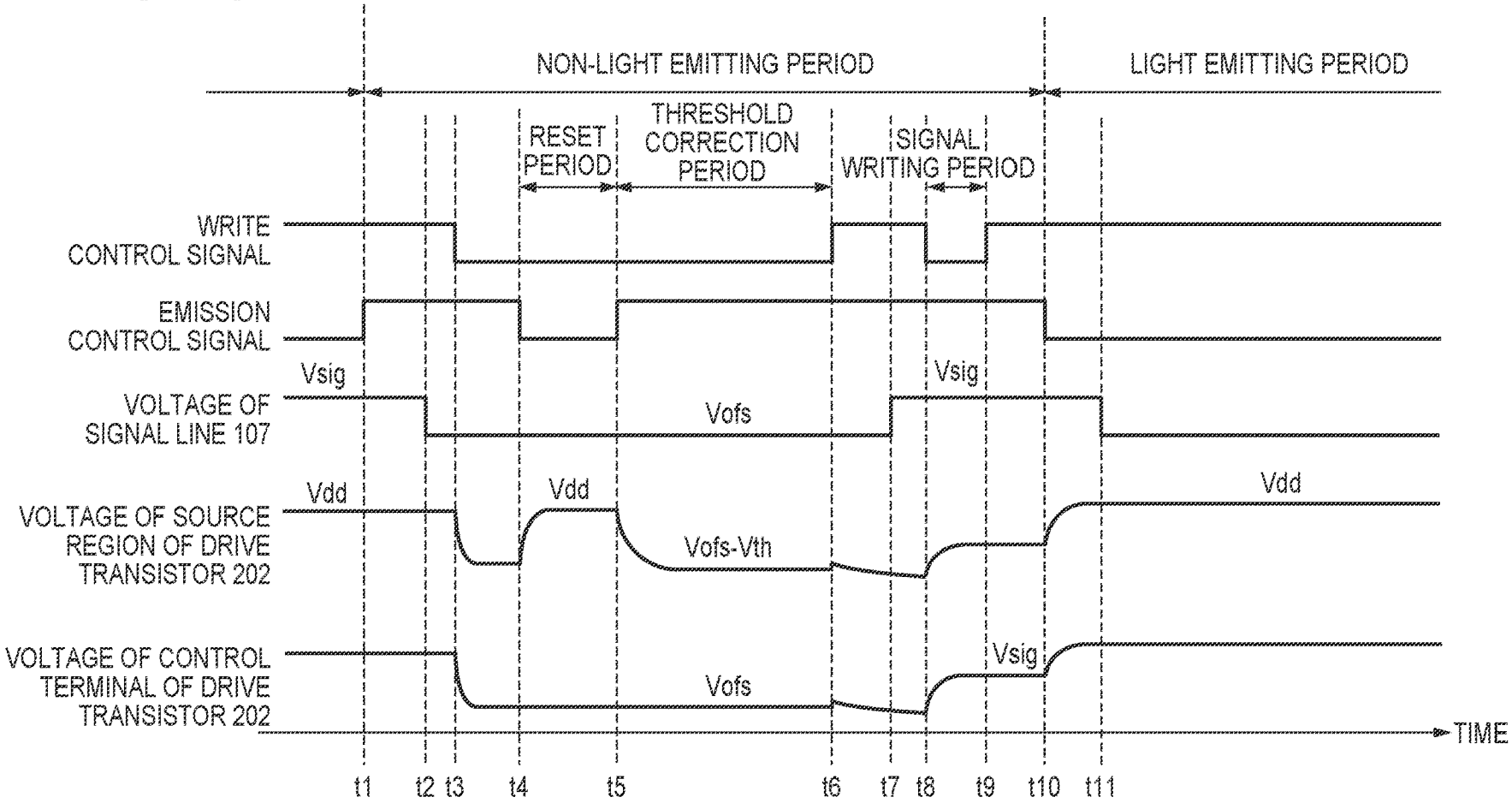
FIG. 8 is a timing chart illustrating an example of an operation of the light-emitting apparatus of FIG. 6.

FIG. 8 is a timing chart illustrating an example of an operation of a light-emitting apparatus 101 of the present embodiment. In FIG. 8, the before the time t1 is the light-emitting period of the light-emitting element 201 in the previous frame. In the light emitting period, the light-emission control transistor 701 is in the on state and the write transistor 203 is in the off state. Here, the light-emitting period may be a period in which the light-emitting element 201 is caused to emit light in accordance with the display data D.

A new frame starts at time t1. At time t1, the light emission control signal input to the control terminal of the light-emission control transistor 701 via the scan line 601 transitions from the Low level to High level. Thus, the light-emission control transistor 701 is turned off. Therefore, from the power supply terminal Vdd, no current is supplied to the light-emitting element 201 via the light-emission control transistor 701 and the drive transistor 202, and the light-emitting element 201 enters a non-light emitting state. Here, the non-light emitting period may be a period in which the light-emitting element 201 is not caused to emit light in accordance with the display data D.

When the non-light emitting period is entered, at time t2, the signal supply circuit 105 switches the voltage of the signal supplied via the signal line 107 from the voltage Vsig of the luminance signal to the voltage Vofs of the threshold value correction signal. Next, at time t3, the write control signal inputted to the control terminal of the write transistor 203 via the scan line 106 transitions from High level to the Low level, and the write transistor 203 turns on. Thus, the voltage Vofs of the threshold value correction signal supplied from the signal supply circuit 105 to the signal line 107 is supplied to the control terminal of the drive transistor 202. At this time, since the voltage of the source region of the drive transistor 202 is in the floating state, the voltage varies under the influence of capacitive coupling between the control terminal and the source region of the drive transistor 202.

Next, at time t4, by the emission control signal transitioning from High level to Low level, the light-emission control transistor 701 is turned on. Thus, the source region of the drive transistor 202 becomes a voltage substantially equal to the power supply terminal Vdd. Thus, the gate terminal of the drive transistor 202 is initialized to the voltage Vofs and the source region is initialized to the voltage of the voltage terminal Vdd. This period is a reset period. In the reset period, from the power supply terminal Vdd, via the light-emission control transistor 701 and the drive transistor 202, a current is supplied to the light-emitting element 201. Therefore, the anode of the light-emitting element 201 is charged, and the voltage Vel of the anode is increased. Therefore, the voltage Vofs and the length of the reset period (time t4 to time t5) may be adjusted so that the voltage Vel of the anode is smaller than the emission threshold value of the light-emitting element 201. Further, if the reset period is sufficiently short, the light emission amount of the light-emitting element 201 also becomes sufficiently small, and therefore even if the voltage Vel of the anode exceeding the light emission threshold value of the light-emitting element 201, the effect on the display quality of the light-emitting apparatus 101 will be small.

After initializing the potential of the gate terminal and the source region of the drive transistor 202, by the emission control signal transitioning from the Low level to High level at time t5, the light-emission control transistor 701 is turned off. Thus, the reset period ends, and the voltage Vs of the source region of the drive transistor 202 changes until Vs=Vofs−Vth where the voltage difference between the voltage Vofs and the voltage Vth of the threshold value and the drive transistor 202. Since the voltage Vg of the gate terminal of the drive transistor 202 is equal to Vofs, the voltage Vth of the threshold value of the drive transistor 202 is held in the capacitive element 702. This period (a period from time t5 to time t6) is the threshold correction period. Thus, in the non-light emitting period in which the light-emitting element 201 is not caused to perform light emission according to the display data D, the signal supply circuit 105 supplies a voltage Vofs as a threshold value correction signal to the drive transistor 202, and the light-emission control transistor 701 temporarily turns on. Thus, the light-emission control transistor 701 and the capacitive element 702 function as a threshold correction unit for compensating the voltage Vth of the threshold value of the drive transistor 202.

Next, at time t6, by the write control signal transitioning from High level to Low level, the write transistor 203 is turned off. After the write transistor 203 is turned off, at time t7, the signal supply circuit 105 switches the voltage of the signal supplied via the signal line 107 from the voltage Vofs of the threshold value correction signal to the voltage Vsig of the luminance signal corresponding to the luminance value of the display data D.

When the voltage supplied to the signal line 107 becomes the voltage Vsig of the luminance signal, at time t8, the write control signal transitions from High level to the Low level, and thereby the write transistor 203 is turned on. Thus, the voltage Vsig of the luminance signal is supplied from the signal supply circuit 105 to the control terminal of the drive transistor 202 via the signal line 107. At this time, since the voltage of the source region of the drive transistor 202 is in the floating state, the voltage varies under the influence of capacitive coupling between the gate and source of the drive transistor 202. The change amount of the voltage Vs of the source region of the drive transistor 202 is ΔVs, and Vs=Vofs−Vth+ΔVs. Here, using the capacitance value C2 of the capacitive element 703 and the source capacitance Cs which excludes a capacitance between the gate and the source of the drive transistor 202, ΔVs is represented by the following Equation (2).

$$\Delta Vs=(Vsig-Vofs)\cdot C2/(Cs+C2) \tag{2}$$

Next, at time t9, by the write control signal transitioning from High level to Low level, the write transistor 203 is turned off. Thus, from time t8 to time t9 is a signal writing period for setting the voltage of the control terminal of the drive transistor 202 to the voltage Vsig of the luminance signal.

By the emission control signal transitioning from High level to the Low level at time t10 after the luminance signal is supplied to the drive transistor 202, the light-emission control transistor 701 is turned on. At this time, the voltage of the source region of the drive transistor 202 becomes a voltage substantially equal to the power supply terminal Vdd, and a current is supplied to the light-emitting element 201 from the power supply terminal Vdd via the light-emission control transistor 701 and the drive transistor 202. As a result, the anode of the light-emitting element 201 is charged, and the voltage Vel of the anode is increased. By the voltage Vel of the anode of the light-emitting element 201 becoming a potential above the emission threshold value, the light-emitting element 201 starts emitting light. Also, the voltage at the control terminal of the drive transistor 202 varies under the influence of capacitive coupling between the gate and the source and between the gate and the drain. The change amount of the voltage Vg of the control terminal of the drive transistor 202 is ΔVg, and Vg=Vsig+ΔVg. Here, using the gate capacitance Cg which excludes a capacitance between the gate and the source of the drive transistor 202, ΔVg is represented by the following Equation (3).

$$\Delta Vg=(Vdd-Vs)\cdot C2/(Cg+C2) \tag{3}$$

Here, it is assumed that the gate capacitance Cg is the parasitic capacitance between the gate and the drain of the drive transistor 202, and the parasitic capacitance between the control terminal of the write transistor 203 and the control terminal of the drive transistor 202. In this case, the gate capacitance Cg is assumed to be sufficiently small with respect to the capacitance value C2 of the capacitive element 703. Therefore, the Equation (3) is expressed by the following Equation (4) using the Equation (2).

$$\Delta Vg=Vdd-Vs=Vdd-\{(Vofs+Vth+(Vsig-Vofs)\cdot C2/(Cs+C2)\} \tag{4}$$

From Equation (4), ΔVg increases the smaller the voltage Vofs of the threshold value correction signal is, and it can be seen that the current flowing through the drive transistor 202 becomes smaller. This will be described later. From time t1 to time t10 is a non-light emitting period in which the light-emitting element 201 is not caused to perform light emission according to the display data D (luminance signal), and after time t10 is a light emitting period in which the light-emitting element 201 is caused to perform light emission according to the display data D (luminance signal). After having switched to the light emitting period, at time t11, the signal supply circuit 105 may switch the voltage supplied via the signal line 107 from the voltage Vsig of the luminance signal to the voltage Vofs of the threshold value correction signal.

Figure 9A:
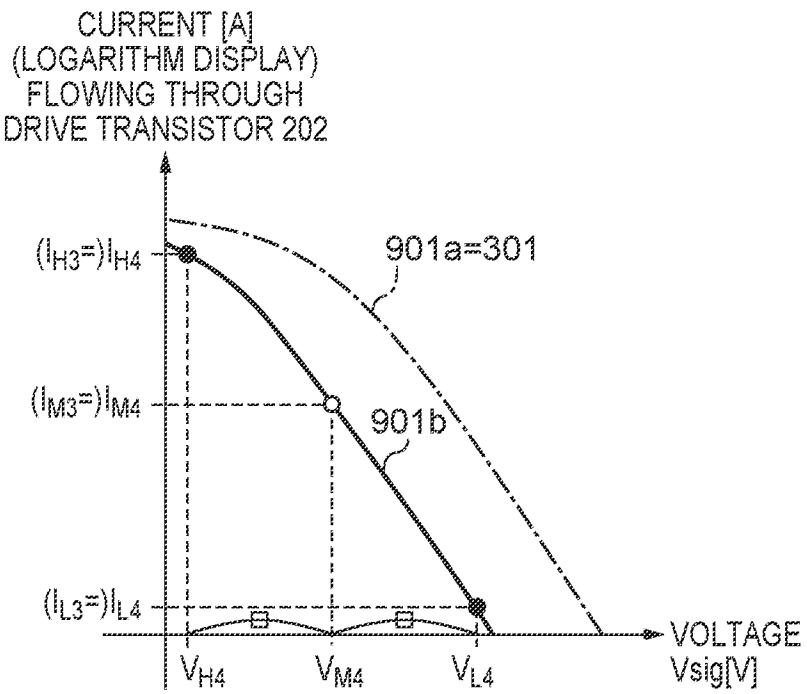
FIGS. 9A and 9B are electrical characteristics and emission characteristics of pixels of the light-emitting apparatus of FIG. 6.

In FIG. 9A, there is illustrated a range of the voltage Vsig of a luminance signal written to a control terminal of the drive transistor 202 in the display mode B of the light-emitting apparatus 101 which comprises the pixel 102 including the light-emission control transistor 701. The current characteristic 901*a* is a current characteristic when the voltage Vofsa is supplied as the voltage Vofs of the threshold value correction signal in the above-described threshold correction period, and is the same as the current characteristic 301 illustrated in FIG. 3A. The current characteristic 901*b* is a current characteristic when supplying a voltage Vofsb as the voltage Vofs of the threshold value correction signal. Here, it is Vofsa>Vofsb.

Consider a case where the drive transistor 202 is caused to operate with the current characteristic 901*b* to display in the display mode B. The voltage Vsig of the luminance signal to be written to the drive transistor 202 of the pixel 102 is $V_{H4}$, $V_{M4}$, and $V_{L4}$ respectively when the display data D has a maximum luminance value, an intermediate luminance value, and a minimum luminance value. The magnitude relation of these voltage values of the voltage Vsig is $V_{H4}<V_{M4}<V_{L4}$. Further, the voltage Vsig of the luminance signal when the display data D is an intermediate luminance value is $V_{M4}=(V_{H4}+V_{L4})/2$. Further, when each of $V_{H4}$, $V_{M4}$, and $V_{L4}$ is supplied as the voltage Vsig of the luminance signal, the current flowing through the drive transistor 202 is $I_{H4}$, $I_{M4}$, and $I_{L4}$, respectively.

A comparison will be given with the case where the drive transistor 202 is caused to operate with the current characteristic 301 and display is performed in the display mode B as illustrated in FIG. 5A. The voltage Vsig of each luminance signal according to the luminance value of the display data D is related to $V_{H4}<V_{H3}$, $V_{M4}<V_{M3}$, and $V_{L4}<V_{L3}$. In the operation described using FIG. 5A, the voltage $V_{L3}$ of the luminance signal corresponding to the minimum luminance value of the display mode B is set to be larger than the voltage $V_{L1}$ of the luminance signal corresponding to the minimum luminance value of the display mode A. At this time, when the voltage $V_{L3}$ of the luminance signal corresponding to the minimum luminance value of the display mode B has become larger than the voltage of the voltage terminal Vdd, the voltage of the control terminal of the drive transistor 202 will become larger than the voltage Vdd of the back gate terminal after the signal writing period. In this case, forward bias current flows from the control terminal of the drive transistor 202 to the back gate terminal, and it becomes impossible to hold the voltage $V_{L3}$ of the luminance signal. In the display mode B, in order to prevent the voltage Vsig of the luminance signal from becoming unholdable when the luminance value of the display data D is low, the voltage Vofs of the threshold value correction signal is adjusted. Thus, the voltage $V_{L4}$ of the luminance signal can be set to be equal to or less than the voltage of the power supply terminal Vdd.

For example, in the display mode A, the signal supply circuit 105 supplies a voltage Vofsa as a threshold value correction signal to the drive transistor 202, and in the display mode B, the signal supply circuit 105 supplies a voltage Vofsb whose voltage value is smaller than the voltage Vofsa as a threshold value correction signal to the drive transistor 202.

At this time, the voltage Vofs of the threshold value correction signal may be adjusted so that the voltage Vsig signal supply circuit 105 to be supplied to the drive transistor 202 as a luminance signal does not exceed the voltage supplied to the back gate terminal of the drive transistor 202. Further, it was explained that in the operation illustrated in FIG. 5A, when the display data D has the minimum luminance value, the voltage Vsig of the luminance signal supplied in the display mode B is made to be larger than the voltage Vsig of the luminance signal supplied in the display mode A. However, when adjusting the voltage Vofs of the threshold value correction signal illustrated in FIG. 9A, the voltage Vsig of the luminance signal supplied in the display mode B, as illustrated in FIG. 9A, may be smaller than the voltage Vsig of the luminance signal supplied in the display mode A. However, when adjusting the voltage Vofs of the threshold value correction signal, the voltage Vsig of the luminance signal supplied in the display mode B may become larger than the voltage Vsig of the luminance signal supplied in the display mode A in accordance with the voltage value of the voltage Vofs. In any case, when the display data D has the minimum luminance value, the signal supply circuit 105 may supply a different voltage Vsig as a luminance signal to the drive transistor 202 in display mode A and in display mode B.

Figure 9B:
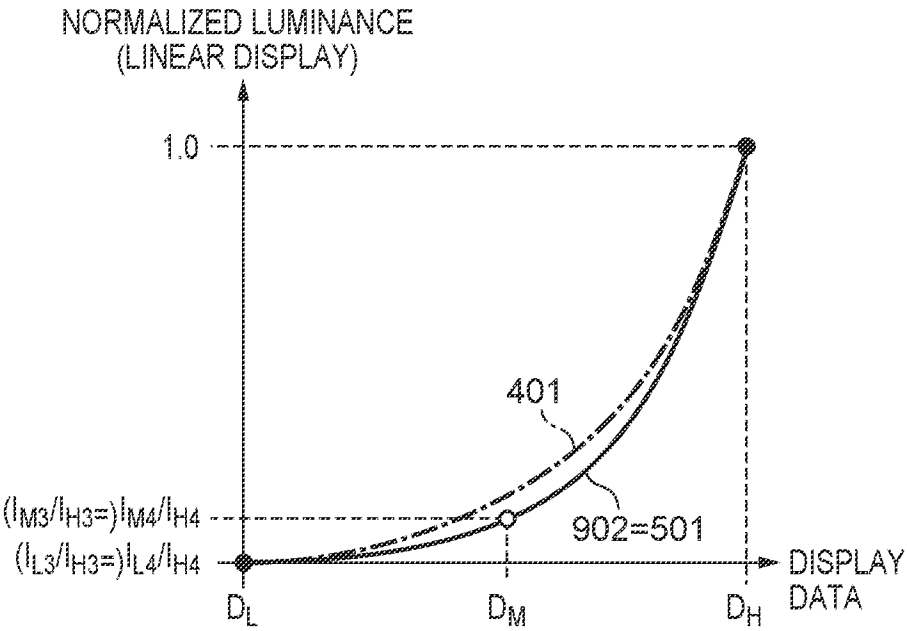

A gamma curve 902 representing emission characteristics of the light-emitting element 201 of the pixel 102 of the display mode B when the drive transistor 202 is operated with the current characteristic 901*b* illustrated in FIG. 9A is illustrated in FIG. 9B. The gamma curve 902 may be similar to the gamma curve 501 in the display mode B in which the drive transistor 202 is caused to operate with the current characteristic 301 (901*a*). The voltage Vsig of the luminance signal corresponding to the cases where the display data D is $D_H$, $D_M$, and $D_L$, respectively, is the above-described $V_{H4}$, $V_{M4}$, and $V_{L4}$ respectively. Normalized luminances which are normalized by a luminance at a time when image data $D_H$ having the maximum luminance value is supplied are respectively 1.0, $I_{M4}/I_{H4}$, and $I_{L4}/I_{H4}$. Here, it may be $I_{M4}/I_{H4}=I_{M3}/I_{H3}$ and $I_{L4}/I_{H4}=I_{L3}/I_{H3}$.

By a configuration comprising the light-emission control transistor 701, regardless of the display mode, the voltage of the main terminal of the drive transistor 202 is set to less than or equal to the voltage of the back gate terminal, and it is possible to cause the light-emitting element 201 of the pixel 102 to emit light at a desired luminance. With this arrangement, it is possible to increase the flexibility of the range of the voltage Vsig of the luminance signal selected to suppress the variation of the gamma curve when the display mode is changed.

Figure 10:
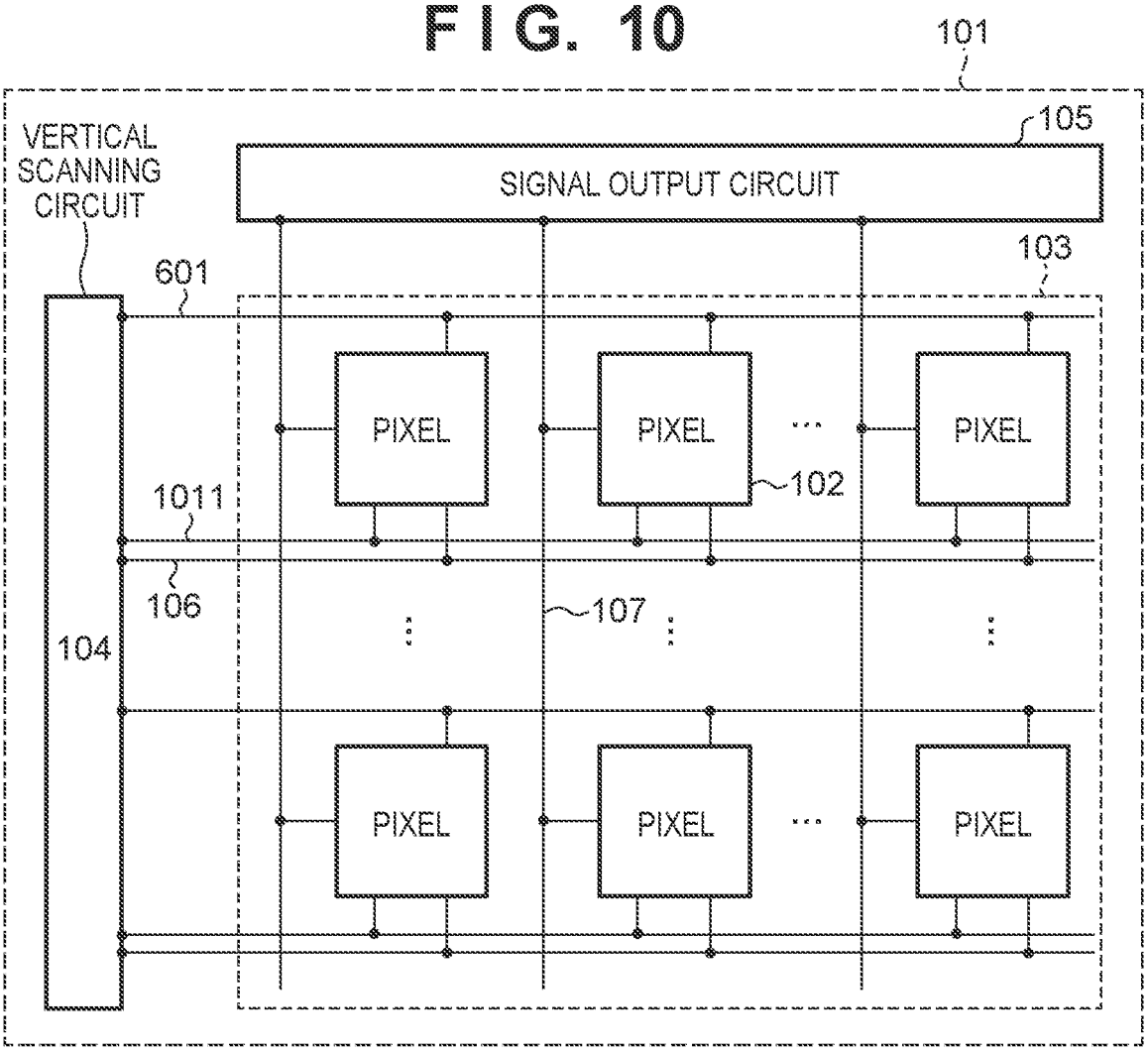
FIG. 10 is a diagram illustrating an outline of a light-emitting apparatus of the present embodiment.
Figure 11:
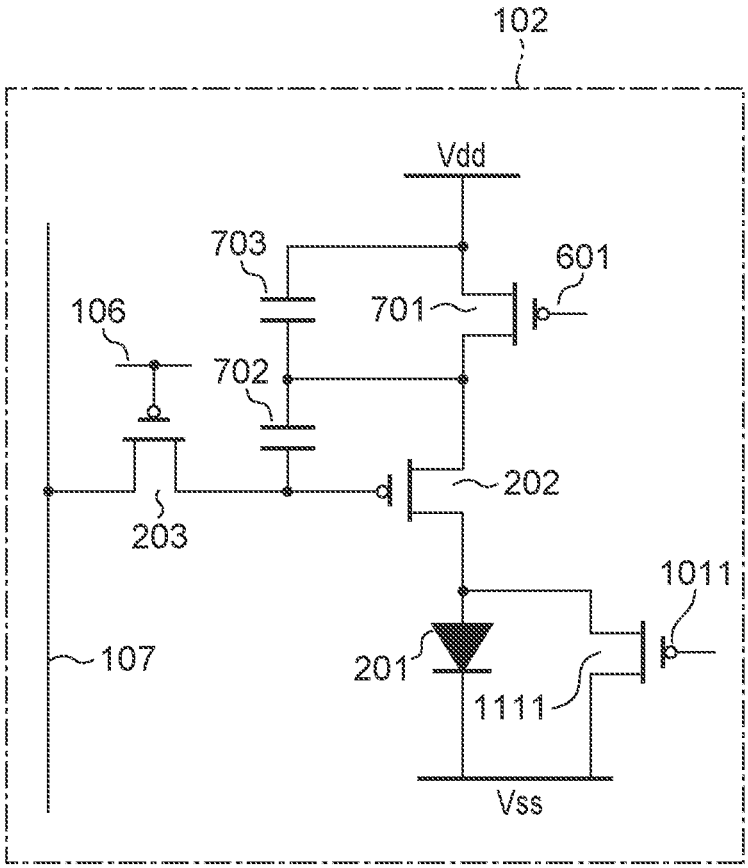
FIG. 11 is a circuit diagram of a pixel of the light-emitting apparatus of FIG. 10.
Figure 12:
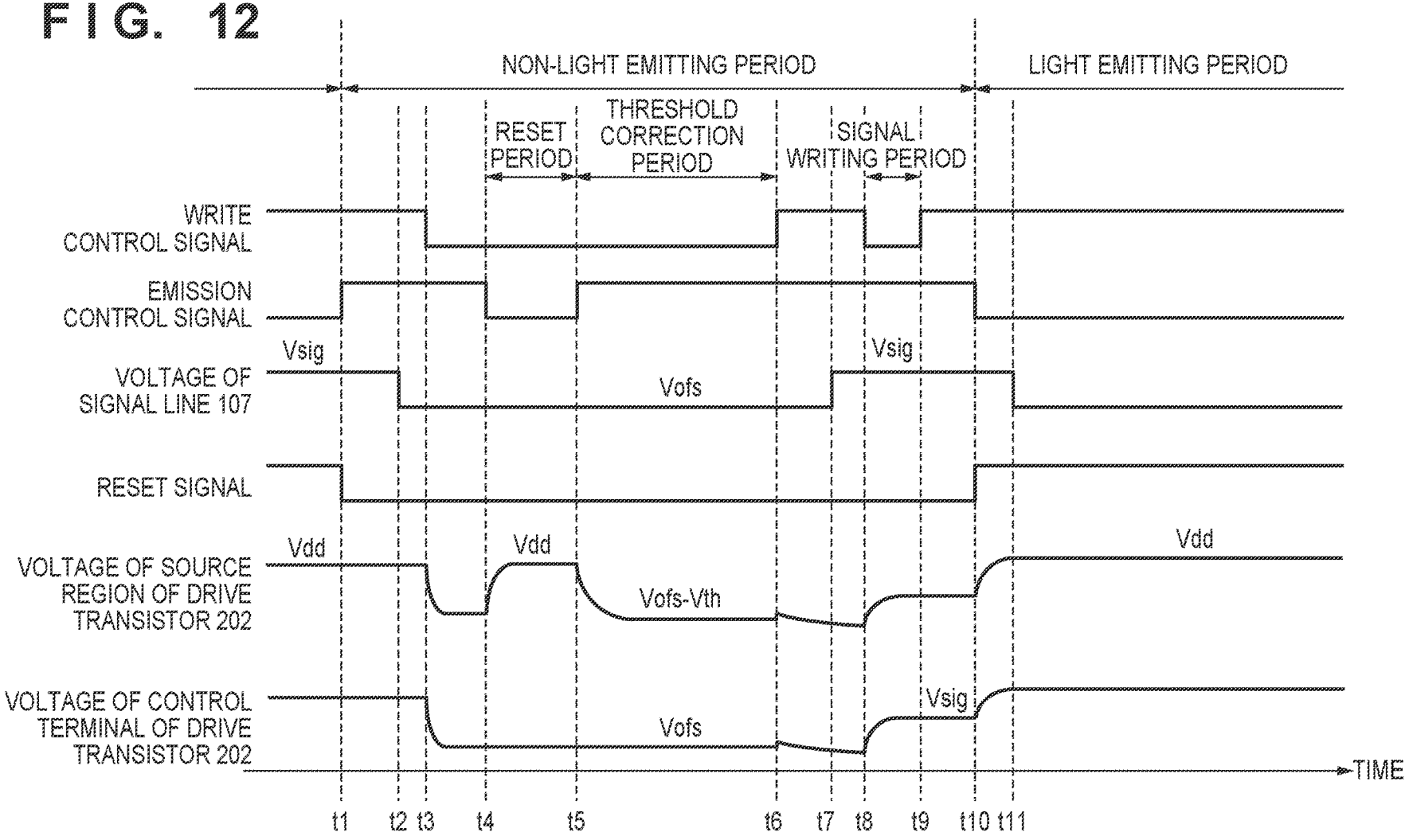
FIG. 12 is a timing chart illustrating an example of the operation of the light-emitting apparatus of FIG. 10.

Next, referring to FIG. 10 to FIG. 12, a variation of the light-emitting apparatus 101 of the present embodiment will be described. The configuration illustrated in FIG. 10 to FIG. 12 is such that each of the pixels 102 further includes a reset transistor 1111 for shorting between the two main terminals of the light-emitting element 201 and connecting the anode of the light-emitting element 201 to a power supply terminal Vss 205. Hereinafter, configurations that differ from a configuration that has been described with reference to FIG. 6 to FIG. 9B described above will be mainly described, and description of configurations that may be the same will be abbreviated as appropriate.

FIG. 10 is a system view illustrating an outline of a light-emitting apparatus 101 of the present embodiment. In addition to the configuration illustrated in FIG. 6, in the pixel array 103, along the row direction, a scan line 1011 is arranged for each pixel row. The scan lines 1011 are connected to the output ends of respective corresponding rows of the vertical scanning circuit 104 and supply a reset signal to the reset transistor 1111 of the respective pixels 102.

FIG. 11 is a circuit diagram illustrating a configuration example of a pixel 102 arranged in the light-emitting apparatus 101 of FIG. 10. The pixel 102 illustrated in FIG. 11 further includes a reset transistor 1111 for shorting between the two main terminals of the light-emitting element 201 as compared to the configuration of the pixel 102 illustrated in FIG. 7. One of the main terminals of the reset transistor 1111 (source region in the configuration of FIG. 11) is connected to one of the main terminals of the drive transistor 202 (drain region in the configuration of FIG. 11). The other of the main terminals of the reset transistor 1111 is connected to the power supply terminal Vss. The control terminal of the reset transistor 1111 is connected to the scan line 1011. By making the reset transistor 1111 conductive when transitioning to the non-light emitting period, the anode of the light-emitting element 201 is connected to the power supply terminal Vss, and the light-emitting element 201 enters a non-light emitting state.

FIG. 12 is a timing chart illustrating an example of an operation of a light-emitting apparatus 101 of the present embodiment. As illustrated in FIG. 12, at a time t1 of transition from the light emitting period to the non-light emitting period, the reset signal inputted to the control terminal of the reset transistor 1111 via the scan line 1011 transitions from High level to the Low level. Thus, the reset transistor 1111 is turned on, and the light-emitting element 201 enters a non-light emitting state. Further, at a time t10 of transition from the non-light emitting period to the light-emitting period, the reset transistor 1111 is turned off by the reset signal transitioning from the Low level to High level. Thus, the light-emitting element is enabled to start to emit light at a luminance corresponding to the luminance signal.

In this embodiment, during the period from time t1 to time t10, since the voltage Vel of the anode of the light-emitting element 201 is a voltage that is substantially equal to the power supply terminal Vss, the light-emitting element 201 is in a non-light emitting state. Therefore, it is possible to realize a display apparatus with high contrast as compared with each of the above-described embodiments. For example, it is possible to suppress that the light-emitting element 201 is emitted in the reset period from time t4 to time t5, and the selection of the length of the voltage Vofs and the reset period can be extended. Thus, by arranging the reset transistor 1111, the image quality of the image displayed on the light-emitting apparatus 101 can be further improved.

In the configuration illustrated in FIG. 10 to FIG. 12, a configuration in which both the light-emission control transistor 701 and the reset transistor 1111 are arranged in the pixel 102 is illustrated. However, limitation is not made to this. In the configuration illustrated in FIG. 10 to FIG. 12, configuration may be such that the light-emission control transistor 701 is not arranged. Even in this case, in the non-light emitting period, the anode of the light-emitting element 201 is connected to the power supply terminal Vss by the reset transistor 1111, and the effect of turning off the light-emitting element 201 more reliably is obtained.

Here, application examples in which the light-emitting apparatus 101 of the present embodiment is applied to a display apparatus, a photoelectric conversion apparatus, an electronic device, an illumination apparatus, a moving body, and a wearable device will be described with reference to FIG. 13 to FIG. 19. Other applications of the light-emitting apparatus 101 include an exposure light source of an electrophotographic image forming device, a backlight of a liquid crystal display device, and a light-emitting device having a color filter in a white light source. The display apparatus may be an image information processing apparatus having an image input unit for inputting image information from an area CCD, a linear CCD, a memory card, or the like; having an information processing unit for processing the input information; and that displays an inputted image on the display unit. Further, the display unit that the camera or the ink jet printer has may have a touch panel function. The method for driving the touch panel function may be an infrared method, a capacitive method, a resistive film method, or an electromagnetic induction method, and is not particularly limited. The display apparatus may be used in a display unit of a multifunction printer.

Figure 13:
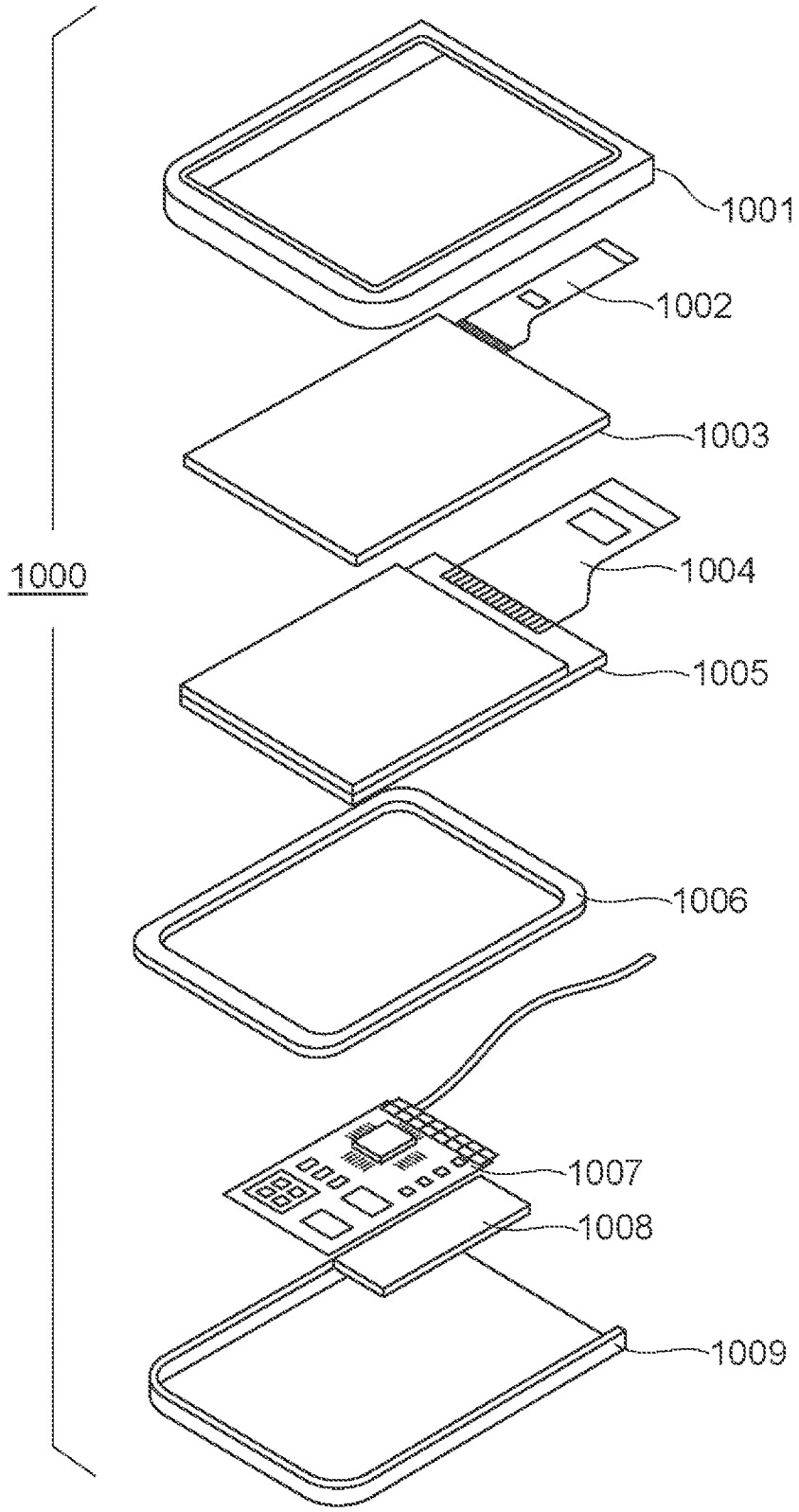
FIG. 13 is a diagram illustrating an example of a display apparatus using the light-emitting apparatus of this embodiment.

FIG. 13 is a schematic diagram expressing an example of a display apparatus using the light-emitting apparatus 101 of the present embodiment.

The display apparatus 1000 may include a touch panel 1003, a display panel 1005, a frame 1006, a circuit board 1007, and a battery 1008 between an upper cover 1001 and a lower cover 1009. Flexible printed circuit FPCs 1002 and 1004 are connected to the touch panel 1003 and the display panel 1005. On the circuit board 1007, active elements such as transistors are arranged. If the display apparatus 1000 is not a portable device, the battery 1008 need not be provided, and even in the case of a portable device, the battery 1008 need not be provided at this position. The light-emitting apparatus 101 described above can be applied to the display panel 1005. The light-emitting apparatus 101, which functions as a display panel 1005, is connected to an active element such as a transistor arranged on the circuit board 1007.

The display apparatus 1000 illustrated in FIG. 13 may be used in a display unit of a photoelectric conversion apparatus (imaging apparatus) having an optical unit having a plurality of lenses, and an image-capturing element for receiving and photoelectrically converting light passing through the optical unit to an electric signal. The photoelectric conversion apparatus may include a display unit for displaying information acquired by the image-capturing element. Also, the display unit may be a display unit exposed to the outside of the photoelectric conversion apparatus or a display unit disposed in a viewfinder. The photoelectric conversion apparatus may be a digital camera or a digital video camera.

Figure 14:
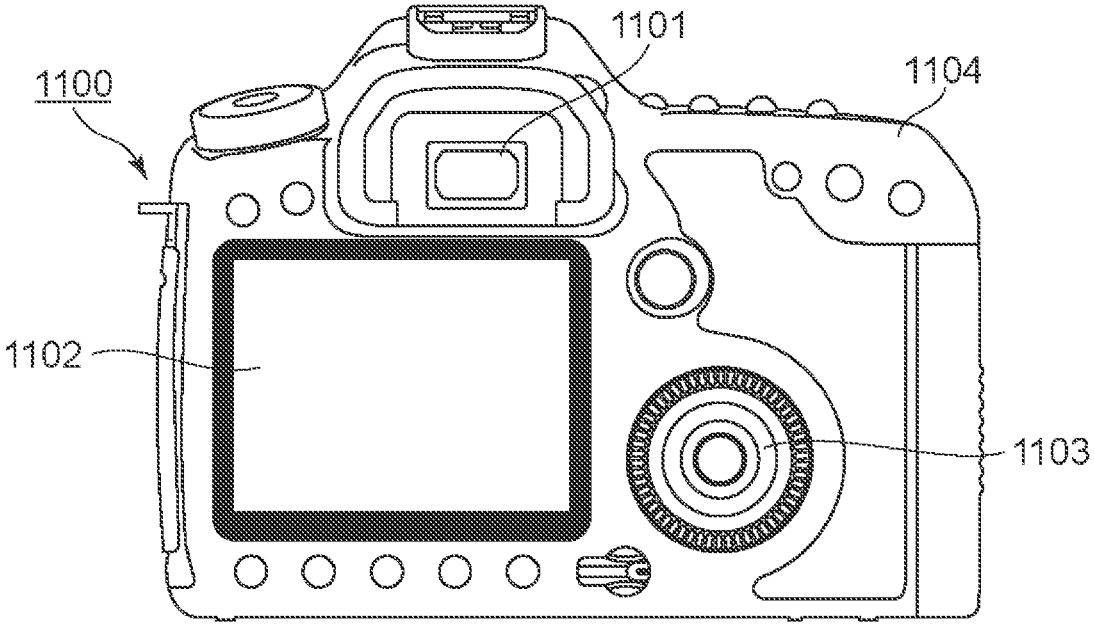
FIG. 14 is a diagram illustrating an example of a photoelectric conversion apparatus using the light-emitting apparatus of this embodiment.

FIG. 14 is a schematic diagram expressing an example of a photoelectric conversion apparatus using the light-emitting apparatus 101 of the present embodiment. The photoelectric conversion apparatus 1100 may include a viewfinder 1101, a back display 1102, an operation unit 1103, and a housing 1104. The photoelectric conversion apparatus 1100 may also be referred to as an imaging apparatus. The light-emitting apparatus 101 described above can be applied to the viewfinder 1101 which is a display unit. In this case, the light-emitting apparatus 101 may display not only an image to be captured but also environmental information, an image capturing instruction, and the like. The environmental information may be the intensity of the external light, the direction of the external light, the speed at which the subject moves, the possibility that the subject is shielded by the shielding object, and the like.

Since the timing suitable for image capturing is often a small amount of time, it is better to display the information as early as possible. Therefore, the light-emitting apparatus 101 including an organic light-emitting material such as an organic EL element can be used as the light-emitting element 201 in the viewfinder 1101. This is because the organic light emitting material has a high response speed. The light-emitting apparatus 101 using an organic light-emitting material can be used more suitably than a liquid crystal display device for these apparatuses for which display speed is required.

The photoelectric conversion apparatus 1100 has an optical unit (not shown). The optical unit has a plurality of lenses, and forms an image on the photoelectric conversion element (not shown) which is accommodated in the housing 1104 for receiving light passing through the optical unit. The plurality of lenses can be adjusted in focus by adjusting their relative positions. This operation can also be performed automatically.

The light-emitting apparatus 101 may be applied to a display unit of an electronic device. In this case, both the display function and the operation function may be provided. Examples of the mobile terminal include a mobile phone such as a smart phone, a tablet, and a head-mounted display.

Figure 15:
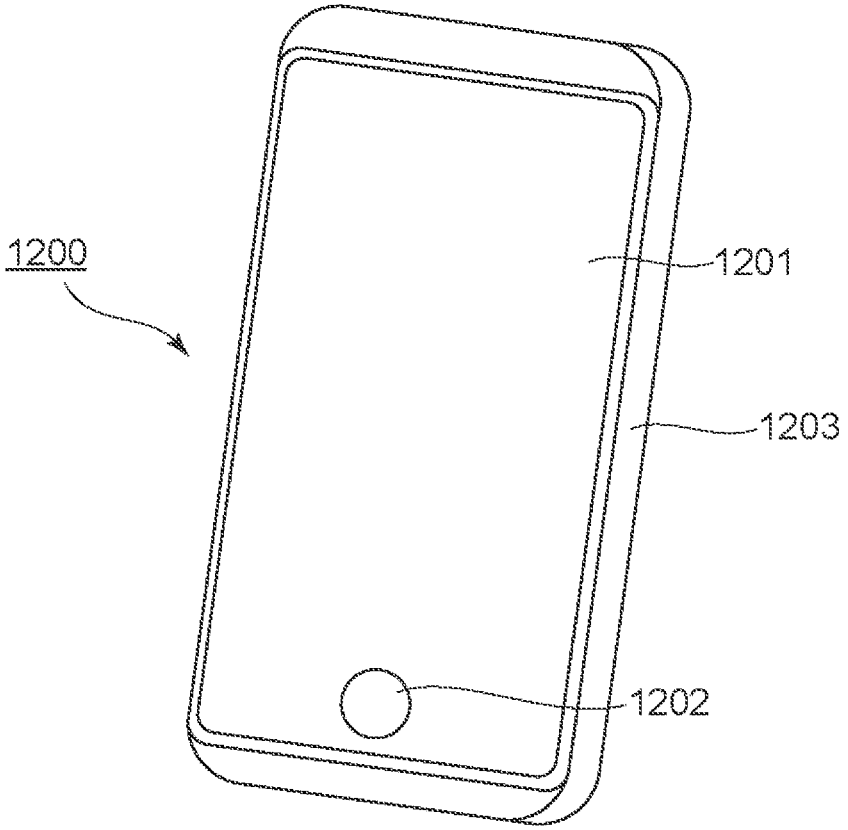
FIG. 15 is a diagram illustrating an example of an electronic device using the light-emitting apparatus of this embodiment.

FIG. 15 is a schematic diagram expressing an example of an electronic device using the light-emitting apparatus 101 of the present embodiment.

An electronic device 1200 includes a display unit 1201, an operation unit 1202, and a housing 1203. The housing 1203 may include a circuit, a printed circuit board having the circuit, a battery, and a communication unit. The operation unit 1202 may be a button or a touch panel type sensing unit. The operation unit 1202 may be a biometric recognition unit that recognizes a fingerprint and performs unlocking or the like. The portable device having the communication unit can also be referred to as a communication device. The light-emitting apparatus 101 described above can be applied to the display unit 1201.

Figure 16A:
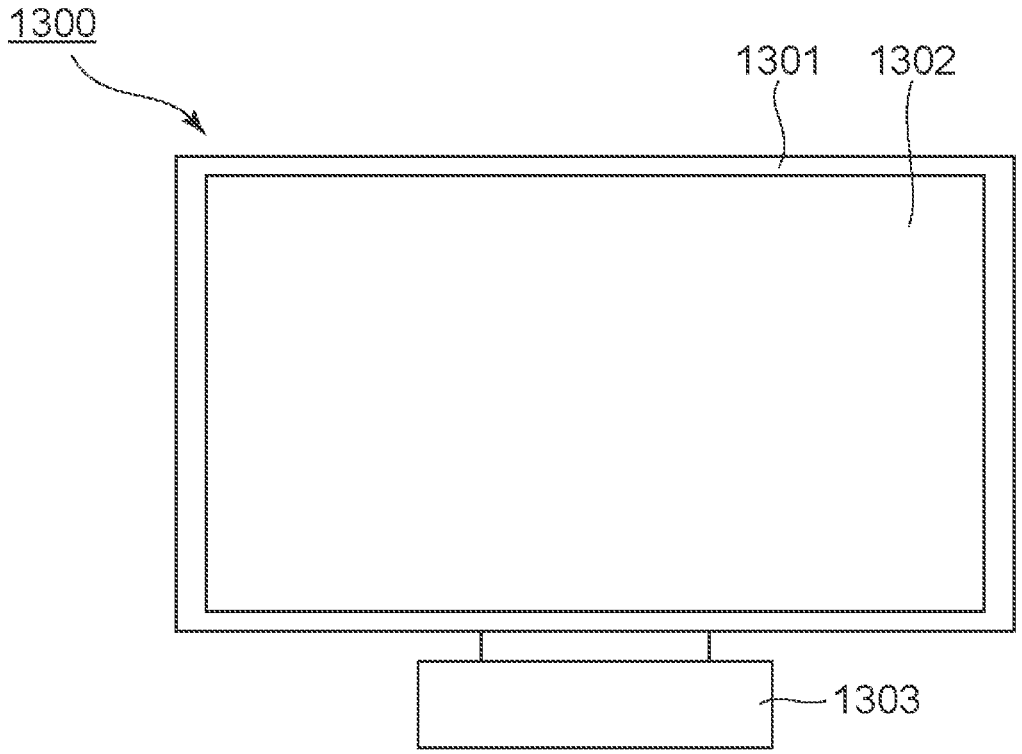
FIGS. 16A and 16B are diagrams illustrating examples of a display apparatus using the light-emitting apparatus of this embodiment.
Figure 16B:
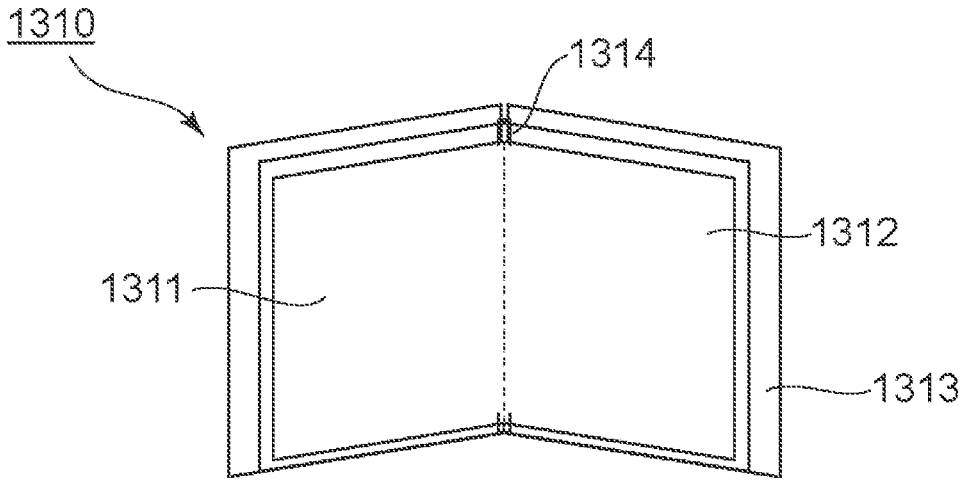

FIG. 16A and FIG. 16B is a schematic diagram expressing an example of the display apparatus using the light-emitting apparatus 101 of the present embodiment. FIG. 16A is a display apparatus such as a television monitor or a PC monitor.

The display apparatus 1300 has a frame 1301 and has a display unit 1302. The light-emitting apparatus 101 described above can be applied to the display unit 1302. The display apparatus 1300 may include a base 1303 supporting a frame 1301 and a display unit 1302. The base 1303 is not limited to the form shown in the FIG. 16A. For example, the lower side of the frame 1301 may also serve as the base 1303. The frame 1301 and the display unit 1302 may be bent. The radius of curvature may be 5000 mm or more and 6000 mm or less.

FIG. 16B is a schematic diagram expressing another example of a display apparatus using the light-emitting apparatus 101 of the present embodiment. The display apparatus 1310 in FIG. 16B is configured to be foldable, and is a so-called foldable display apparatus. The display apparatus 1310 includes a first display unit 1311, a second display unit 1312, a housing 1313, and a bending point 1314. The light-emitting apparatus 101 described above can be applied to the first display unit 1311 and the second display unit 1312. The first display unit 1311 and the second display unit 1312 may be one seamless display apparatus. The first display unit 1311 and the second display unit 1312 can be separated from each other by a bending point. The first display unit 1311 and the second display unit 1312 may display respectively different images, or one image may be displayed by the first display unit and the second display unit.

Figure 17:
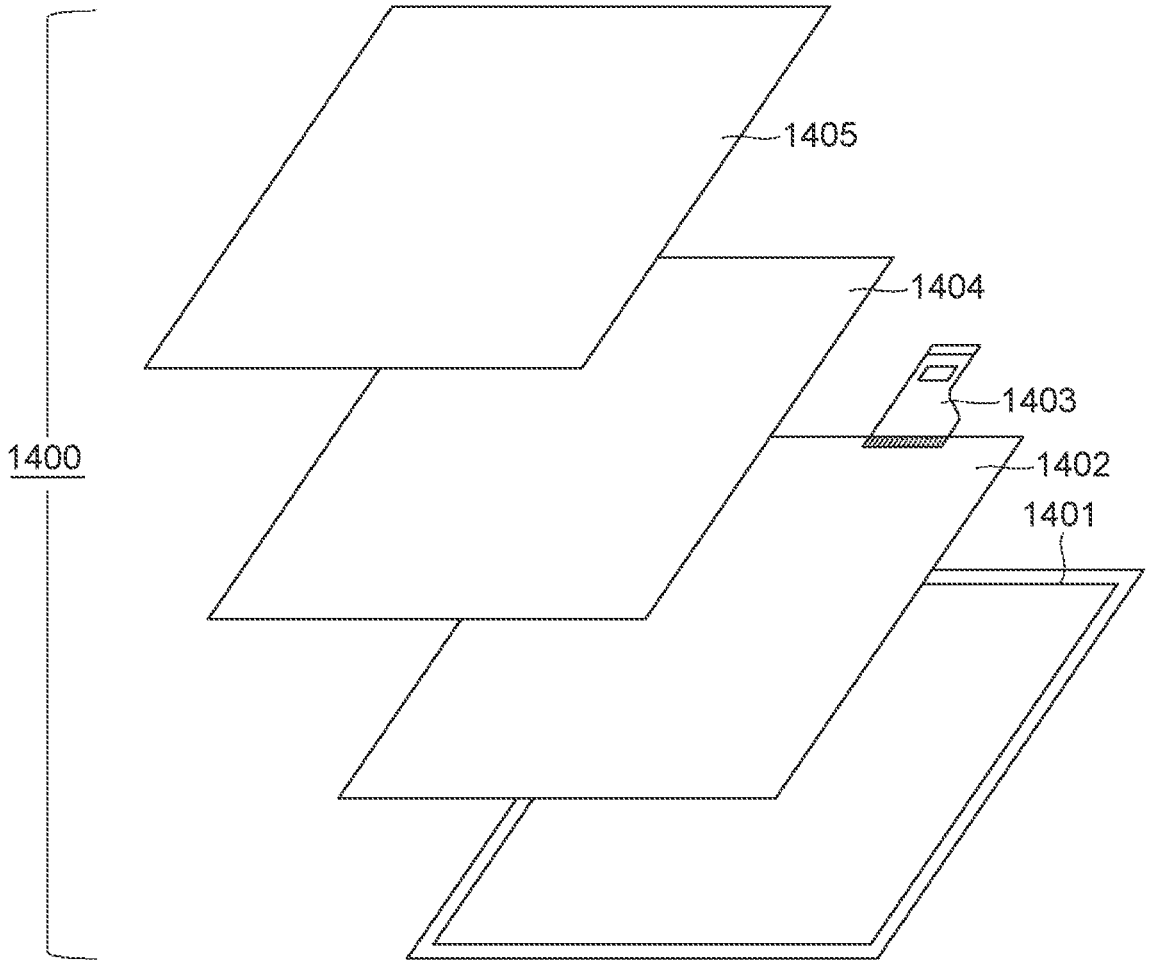
FIG. 17 is a diagram illustrating an example of an illumination apparatus using the light-emitting apparatus of this embodiment.

FIG. 17 is a schematic diagram expressing an example of an illumination apparatus using the light-emitting apparatus 101 of the present embodiment.

The illumination apparatus 1400 may include a housing 1401, a light source 1402, a circuit board 1403, an optical film 1404, and a light diffusion unit 1405. The light-emitting apparatus 101 described above can be applied to the light source 1402. The optical film 1404 may be a filter that improves color rendering of the light source. A light diffusion unit 1405, such as a light-up, effectively diffuses the light of the light source, and can deliver light in a wide range. If necessary, a cover may be provided on the outermost portion. The illumination apparatus 1400 may have both the optical film 1404 and the light diffusion unit 1405, or may have only one of them.

The illumination apparatus 1400 is, for example, an apparatus for illuminating the room. The illumination apparatus 1400 may emit white, daylight white, or any other color from blue to red. A dimming circuit for dimming them may be provided. The illumination apparatus 1400 may have a power supply circuit connected to the light-emitting apparatus 101 that serves as a light source 1402. A power supply circuit is a circuit for converting an AC voltage into a DC voltage. In addition, white has a color temperature of 4200 K, and daylight white has a color temperature of 5000 K. The illumination apparatus 1400 may also have a color filter. Also, the illumination apparatus 1400 may also have a heat dissipation portion. The heat dissipation portion is for emitting heat in the apparatus to the outside of the apparatus, and may be a metal with high specific heat, liquid silicon, or the like.

Figure 18:
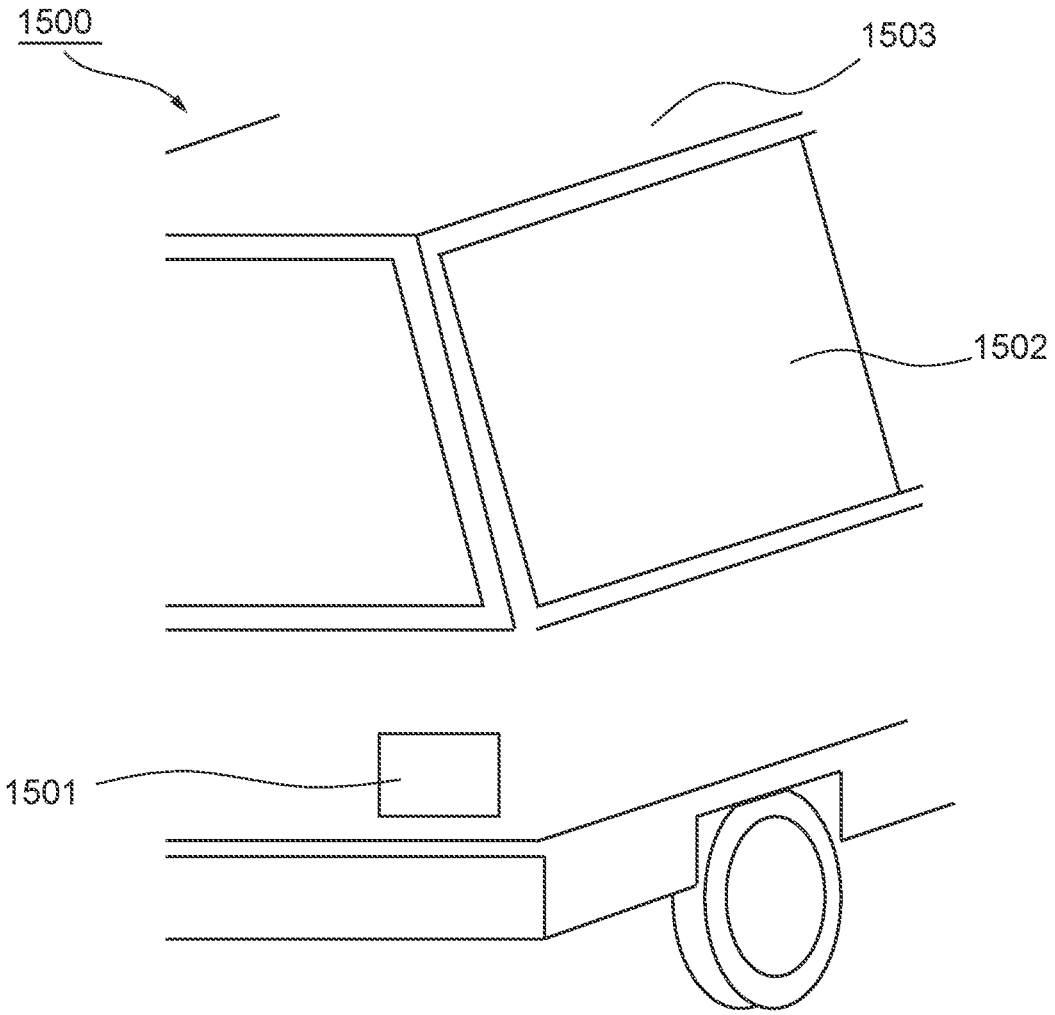
FIG. 18 is a diagram illustrating an example of a moving body using the light-emitting apparatus of this embodiment.

FIG. 18 is a schematic diagram of an automobile having a tail lamp which is an example of a lighting unit for a vehicle using the light-emitting apparatus 101 of the present embodiment. The automobile 1500 may have a tail lamp 1501, and light the tail lamp 1501 when a brake operation or the like is performed. The light-emitting apparatus 101 of the present embodiment may be used as a lighting unit as a head lamp for a vehicle. An automobile is an example of a moving body, and the moving body may be a ship, a drone, an aircraft, a railway vehicle, an industrial robot, or the like. The moving body may have a body and a lighting unit provided thereon. The lighting unit may be used to inform the current position of a body.

The light-emitting apparatus 101 described above can be applied to the tail lamp 1501. The tail lamp 1501 may have a protective member for protecting the light-emitting apparatus 101 functioning as the tail lamp 1501. The protective member may be any material if it is relatively high strength and transparent, and it may be made of a polycarbonate or the like. Further, the protective member may be a furandicarboxylic acid derivative, an acrylonitrile derivative, or the like mixed with a polycarbonate.

The automobile 1500 may have a body 1503, a window 1502 attached thereto. Windows may be for confirming what is in front of or behind the automobile and may be transparent displays. In such a transparent display, the above-described light-emitting apparatus 101 in which the light emitting layer of the organic layer 305 includes an organic light emitting material and functions as a light-emitting apparatus may be used. In this case, a constituent material such as an electrode included in the light-emitting apparatus 101 is formed of a transparent member.

Referring to the FIG. 19A and FIG. 19B, further application examples of the light-emitting apparatus 101 of the above-described embodiments will be described. The light-emitting apparatus 101 can be applied to a system that can be mounted as a wearable device such as a smart glass, a head mounted display (HMD), or a smart contact. A captured-image display apparatus used in such an application example has an imaging apparatus that can photoelectrically convert visible light, and a light-emitting apparatus capable of emitting visible light.

Figure 19A:
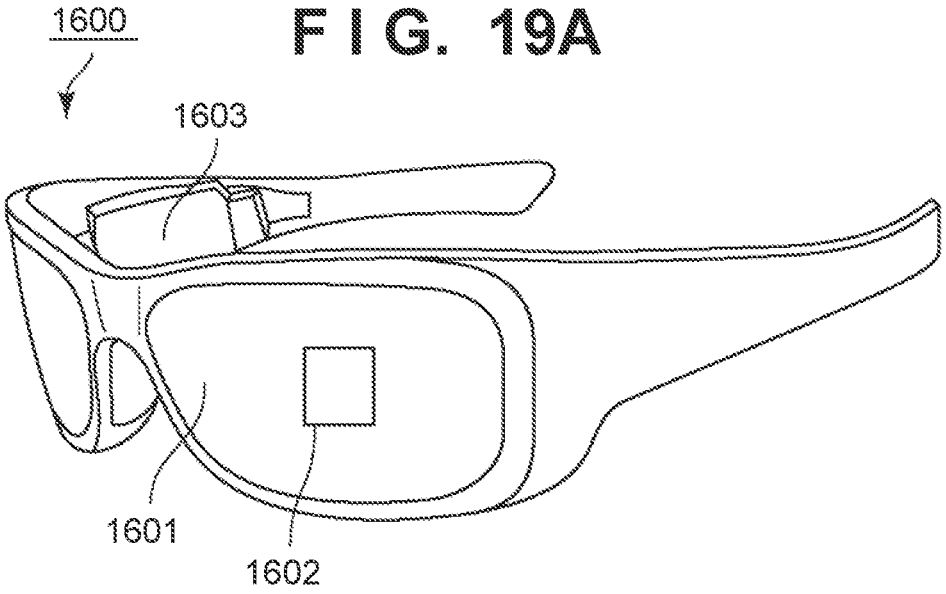
FIGS. 19A and 19B are diagrams illustrating examples of a wearable device using the light-emitting apparatus of this embodiment.

FIG. 19A describes eyeglasses 1600 (smart glasses) according to one application example. On the front surface side of the lens 1601 of the eyeglasses 1600, an imaging apparatus 1602 such as a CMOS sensor or an SPAD is provided. The light-emitting apparatus 101 of each of the embodiments described above is provided on the back surface side of the lens 1601.

The eyeglasses 1600 further include a control apparatus 1603. The control apparatus 1603 functions as a power supply for supplying power to the light-emitting apparatus 101 according to the image capturing apparatus 1602 and the embodiments. Further, the control apparatus 1603 controls the operation of the image capturing apparatus 1602 and the light-emitting apparatus 101. In the lens 1601, an optical system for focusing the light on the imaging apparatus 1602 is formed.

Figure 19B:
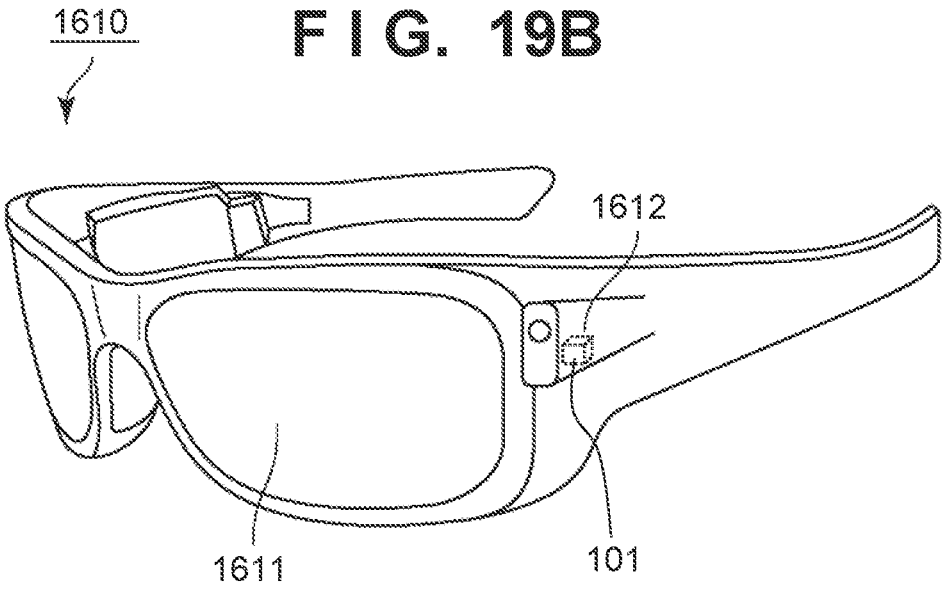

FIG. 19B describes eyeglasses 1610 (smart glasses) according to one application example. The eyeglasses 1610 have the control apparatus 1612, and the imaging apparatus corresponding to the imaging apparatus 1602 and the light-emitting apparatus 101 are mounted on the control apparatus 1612. On the lens 1611, an imaging apparatus within the control apparatus 1612 and an optical system for projecting light emission from the light-emitting apparatus 101 are formed, and an image is projected on the lens 1611. The control apparatus 1612 functions as a power supply for supplying power to the imaging apparatus and the light-emitting apparatus 101, and controls the operation of the imaging apparatus and the light-emitting apparatus 101. The control apparatus 1612 may have a line-of-sight detection unit that detects the wearer's gaze. Infrared rays may be used to detect the line of sight. The infrared light emitting unit emits infrared light towards the eyeball of the user who is gazing at the display image. The image pickup unit having the light receiving element detects the light of the emitted infrared light reflected from the eyeball, whereby a captured image of the eyeball is obtained. By having a reducing unit for reducing the light from the infrared light emitting portion to the display unit in a plan view, deterioration of image quality is reduced.

The line of sight of the user with respect to the display image is detected from the captured image of the eyeball obtained by capturing infrared light. Any known technique can be applied to the line-of-sight detection using the captured image of the eye. As an example, a line-of-sight detection method based on a Purkinje image by reflection of irradiation light at the cornea can be used.

More specifically, line-of-sight detection processing based on the pupil corneal reflection method is performed. A line of sight of the user is detected by calculating a line-of-sight vector representing the direction (rotation angle) of the eye based on the image of the pupil and the Purkinje image included in the captured image of the eye using the pupil corneal reflection method.

The light-emitting apparatus 101 according to an embodiment of the present invention may have an imaging apparatus having a light receiving element and may control the display image based on the user's line-of-sight information from the imaging apparatus.

Specifically, the light-emitting apparatus 101 determines a first field-of-vision region that the user is gazing at and a second field-of-vision region other than the first field-of-vision region based on the line-of-sight information. The first visual field region and the second visual field region may be determined by the control apparatus of the light-emitting apparatus 101, or may be received as determined by an external control apparatus. In the display area of the light-emitting apparatus 101, the display resolution of the first field-of-vision region may be controlled higher than the display resolution of the second field-of-vision region. That is, the resolution of the second field-of-vision region may be lower than that of the first field-of-vision region.

The display region has a first display region and a second display region different from the first display region, and a region having a high priority is determined from the first display region and the second display region based on the line-of-sight information. The first visual field region and the second visual field region may be determined by the control apparatus of the light-emitting apparatus 101, or may be received as determined by an external control apparatus. The resolution of a region having a high priority may be controlled to be higher than the resolution of a region other than a region having a high priority. That is, the resolution of a region having a relatively low priority may be lowered.

It should be noted that AI may be used to determine the first field-of-vision region or the region having a high priority. The AI may be a model configured to estimate the angle of the line of sight from the image of the eyeball and the distance to the target ahead of the line of sight using the image of the eyeball and the direction in which the eyeball of the image actually was looking as supervisory data. The AI program may be included in the light-emitting apparatus 101, in the imaging apparatus, or in an external apparatus. If the AI program is in an external apparatus, the AI program is transmitted to the light-emitting apparatus 101 by communication.

In the case of display control based on visual detection, it is possible to preferably apply to a smart glass further having an image capturing apparatus for external image capturing. The smart glass can display captured external information in real time.

According to the present invention, it is possible to provide a technique that is advantageous in switching a plurality of display modes in a light-emitting apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-003726, filed Jan. 13, 2021, which is hereby incorporated by reference herein in its entirety.

What is claimed is:

1. A light-emitting apparatus comprising:

a plurality of pixels that each includes a light-emitting element and a drive transistor for supplying a current according to a luminance signal to the light-emitting element; and a signal supply circuit configured to supply the luminance signal to the drive transistor in accordance with display data, wherein the light-emitting apparatus is configured to operate in a plurality of display modes including (1) a first display mode and (2) a second display mode in which a maximum luminance is higher than in the first display mode, and wherein the signal supply circuit, (1) in a case where the display data has a maximum luminance value, in the first display mode, supplies to the drive transistor, as the luminance signal, a first voltage, and in the second display mode, supplies to the drive transistor, as the luminance signal, a second voltage whose voltage value is smaller than the first voltage, and (2) in a case where the display data has a minimum luminance value, in the first display mode, supplies to the drive transistor, as the luminance signal, a third voltage, and in the second display mode, supplies to the drive transistor, as the luminance signal, a fourth voltage whose voltage value is larger than the third voltage.

2. The light-emitting apparatus according to claim 1, wherein a voltage difference between the first voltage and the second voltage is larger than a voltage difference between the third voltage and the fourth voltage.

3. The light-emitting apparatus according to claim 1, wherein each of the plurality of pixels is arranged in a current path including the light-emitting element and the drive transistor, and further comprises a light-emission control transistor for controlling whether the light-emitting element emits light or does not emit light, and wherein in a non-light emitting period in which the light-emitting element is not caused to perform a light emission in accordance with the display data, (1) the signal supply circuit supplies a threshold value correction signal to the drive transistor, and (2) the light-emission control transistor temporarily turns on.

4. The light-emitting apparatus according to claim 3, wherein the signal supply circuit, in the first display mode, supplies to the drive transistor, as the threshold value correction signal, a fifth voltage, and in the second display mode, supplies to the drive transistor, as the threshold value correction signal, a sixth voltage whose voltage value is smaller than the fifth voltage.

5. The light-emitting apparatus according to claim 3, wherein, in a case where the display data has a minimum luminance value, the voltage of the threshold value correction signal is adjusted so that the voltage that the signal supply circuit supplies to the drive transistor as the luminance signal does not exceed the voltage supplied to a back gate terminal of the drive transistor.

6. The light-emitting apparatus according to claim 3, wherein the drive transistor is arranged between the light-emitting element and the light-emission control transistor in the current path, and wherein each of the plurality of pixels further comprises a capacitive element between a control terminal of the drive transistor and a node between the drive transistor and a light-emission control transistor in the current path.

7. The light-emitting apparatus according to claim 1, wherein each of the plurality of pixels further comprises a reset transistor for short-circuiting between two main terminals of the light-emitting element, and wherein in a non-light emitting period in which the light-emitting element is not caused to perform a light emission in accordance with the display data, the reset transistor turns on.

8. The light-emitting apparatus according to claim 1, wherein a number of gradations is the same in the first display mode and the second display mode.

9. The light-emitting apparatus according to claim 1, wherein in each of the first display mode and the second display mode, steps between each gradation of the voltage that the signal supply circuit supplies as the luminance signal are evenly spaced.

10. A display apparatus comprising:

the light-emitting apparatus according to claim 1; and an active element connected to the light-emitting apparatus.

11. A photoelectric conversion apparatus comprising:

the light-emitting apparatus according to claim 1;

an optical unit having a plurality of lenses;

an image-capturing element configured to receive light passing through the optical unit; and a display unit configured to display an image, wherein the display unit is a display unit configured to display an image that the image-capturing element captured.

12. An electronic device comprising:

a housing in which a display unit is provided; and a communication unit provided in the housing and configured to communicate with an outside unit, wherein the display unit comprises the light-emitting apparatus according to claim 1.

13. An illumination apparatus comprising:

a light source; and at least one of (a) a light diffusion unit and (b) an optical film, wherein the light source comprises the light-emitting apparatus according to claim 1.

14. A moving body comprising:

a body; and a lighting unit provided in the body, wherein the lighting unit comprises the light-emitting apparatus according to claim 1.

15. A wearable device comprising a display apparatus for displaying an image, wherein the display apparatus comprises the light-emitting apparatus according to claim 1.

16. A light-emitting apparatus comprising:

a plurality of pixels that each includes a light-emitting element and a drive transistor for supplying a current according to a luminance signal to the light-emitting element; and a signal supply circuit configured to supply the luminance signal to the drive transistor in accordance with display data, wherein the light-emitting apparatus is configured to operate in a plurality of display modes including (1) a first display mode and (2) a second display mode in which a maximum luminance is higher than in the first display mode, wherein the signal supply circuit, (1) in a case where the display data has a maximum luminance value, supplies to the drive transistor, as the luminance signal, different voltages in the first display mode and the second display mode, and (2) in a case where the display data has a minimum luminance value, supplies to the drive transistor, as the luminance signal, different voltages in the first display mode and the second display mode, wherein each of the plurality of pixels is arranged in a current path including the light-emitting element and the drive transistor, and further comprises a light-emission control transistor for controlling whether the light-emitting element emits light or does not emit light, and wherein in a non-light emitting period in which the light-emitting element is not caused to perform a light emission in accordance with the display data, (1) the signal supply circuit supplies a threshold value correction signal to the drive transistor, and (2) the light-emission control transistor temporarily turns on.

17. An electronic device comprising:

a housing in which a display unit is provided; and a communication unit provided in the housing and configured to communicate with an outside unit, wherein the display unit comprises the light-emitting apparatus according to claim 16.

18. A light-emitting apparatus comprising:

a plurality of pixels that each includes a light-emitting element and a drive transistor for supplying a current according to a luminance signal to the light-emitting element; and a signal supply circuit configured to supply the luminance signal to the drive transistor in accordance with display data, wherein the light-emitting apparatus is configured to operate in a plurality of display modes including (1) a first display mode and (2) a second display mode in which a maximum luminance is higher than in the first display mode, wherein the signal supply circuit, (1) in a case where the display data has a maximum luminance value, supplies to the drive transistor, as the luminance signal, different voltages in the first display mode and the second display mode, and (2) in a case where the display data has a minimum luminance value, supplies to the drive transistor, as the luminance signal, different voltages in the first display mode and the second display mode, wherein each of the plurality of pixels further comprises a reset transistor for short-circuiting between two main terminals of the light-emitting element, and wherein in a non-light emitting period in which the light-emitting element is not caused to perform a light emission in accordance with the display data, the reset transistor turns on.

19. An electronic device comprising:

a housing in which a display unit is provided; and a communication unit provided in the housing and configured to communicate with an outside unit, wherein the display unit comprises the light-emitting apparatus according to claim 18.

* * * * *